US009981499B2

(12) United States Patent
Fukumoto

(10) Patent No.: US 9,981,499 B2
(45) Date of Patent: May 29, 2018

(54) BALLPOINT PEN

(71) Applicant: MITSUBISHI PENCIL COMPANY, LIMITED, Tokyo (JP)

(72) Inventor: Takeo Fukumoto, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days. days.

(21) Appl. No.: 15/102,480

(22) PCT Filed: Dec. 9, 2014

(86) PCT No.: PCT/JP2014/082491
§ 371 (c)(1),
(2) Date: Jun. 7, 2016

(87) PCT Pub. No.: WO2015/087852
PCT Pub. Date: Jun. 18, 2015

(65) Prior Publication Data

US 2017/0001464 A1 Jan. 5, 2017

(30) Foreign Application Priority Data

Dec. 9, 2013 (JP) ..... 2013-253945
Dec. 9, 2013 (JP) ..... 2013-253946

(51) Int. Cl.
*B43K 7/00* (2006.01)
*B43K 7/10* (2006.01)
*B43K 1/08* (2006.01)

(52) U.S. Cl.
CPC ..... *B43K 7/005* (2013.01); *B43K 1/08* (2013.01); *B43K 7/00* (2013.01); *B43K 7/10* (2013.01); *B43K 7/105* (2013.01)

(58) Field of Classification Search
CPC . B43K 1/08; B43K 7/005; B43K 7/10; B43K 7/105

(Continued)

(56) References Cited

U.S. PATENT DOCUMENTS 6,283,662 B1 9/2001 Inoue et al.
7,140,799 B2 * 11/2006 Kobayashi ..... B43K 5/1881 401/208

(Continued)

FOREIGN PATENT DOCUMENTS

EP 0 245 506 A1 11/1987
EP 1 800 893 A1 6/2007

(Continued)

OTHER PUBLICATIONS

International Search Report dated Jan. 27, 2015, issued in counterpart International Application No. PCT/JP2014/082491 (1 page).

(Continued)

*Primary Examiner* — Jennifer C Chiang
(74) *Attorney, Agent, or Firm* — Westerman, Hattori, Daniels & Adrian, LLP

(57) ABSTRACT

A ballpoint pen bends at the pen tip, that can be changed by the force applied when writing. Wobbling does not occur, and a stable writing feel can be obtained. The ballpoint pen makes it possible to clearly change the thickness of the drawn line by the force applied when writing, so that lines of different thickness can be written with a single writing tip using the angle of the ballpoint pen tip. The ballpoint pen includes: a writing ball; a holder for holding the writing ball; an ink supply section; a shaft body inside which the ink supply section is held; and a tip shaft, which is connected to the tip of the shaft body and from which the holder protrudes during writing. The tip shaft is formed by two-color molding in which a front half and a back half are interdigitated in a saw tooth form.

8 Claims, 25 Drawing Sheets

(58) Field of Classification Search
USPC ..... 401/209, 214, 216
See application file for complete search history.

(56) References Cited

U.S. PATENT DOCUMENTS

| | | | | |
|---|---|---|---|---|
| 7,862,249 | B2 * | 1/2011 | Ohashi ..... | B43K 1/08 401/209 |
| 9,545,813 | B2 * | 1/2017 | Fukumoto ..... | B43K 1/08 |
| 2005/0123341 | A1 | 6/2005 | Ichikawa et al. | |
| 2008/0219746 | A1 | 9/2008 | Lee et al. | |

FOREIGN PATENT DOCUMENTS

| | | | |
|---|---|---|---|
| EP | 2 130 684 | A1 | 12/2009 |
| JP | 9-240189 | A | 9/1997 |
| JP | 11-34573 | A | 2/1999 |
| JP | 2002-331789 | A | 11/2002 |

OTHER PUBLICATIONS

Extended (supplementary) European Search Report dated Jul. 26, 2017, issued in counterpart European Application No. 14869681.8. (8 pages).

* cited by examiner

BALLPOINT PEN

TECHNICAL FIELD

The present invention relates to a ballpoint pen capable of varying drawn line width.

BACKGROUND ART

As technology related to ballpoint pens that enable tilting of the ballpoint pen tip of a ballpoint pen, ballpoint pens such as those described in Patent Document 1 are known in which an elastic body is interposed between a shaft body and a tip member, such that the ballpoint pen tip is tilted by flexing of the elastic body according to the force during writing.

RELATED DOCUMENTS

Related Patent Documents

Patent Document 1: JP 2002-331789 A

SUMMARY OF INVENTION

Technical Problem

However, issues with the invention described in Patent Document 1 are that the amount of flexing of the ballpoint pen tip is limited by the gap between the shaft body and the tip member, and that wobbling and change in the writing sensation arise with degeneration of the elastic body, such as rubber or elastomer.

The present invention accordingly has a first objective of providing a ballpoint pen in which the amount of flexing in the pen tip can be changed according to the force applied during writing, enabling a stable writing sensation to be obtained without wobbling arising.

A second objective is to provide a ballpoint pen with which, in order to make it possible for the thickness of drawn lines to be markedly varied according to the force applied during writing, it is possible to draw lines of different thicknesses using a single writing tip according to the angle of the ballpoint pen tip.

Solution to Problem

In consideration of the above circumstances, the invention has the following features. Note that reference numerals herein are the reference numerals employed in exemplary embodiments of the present invention, and are not limitations to the technical scope of the present invention.

(First Aspect and Second Aspect)

A first aspect of the present invention is a ballpoint pen including a writing ball 30, a holder 21 that retains the writing ball 30 with a swaged section 23 swaged at a tip end of the holder 21, an ink supply section 40 that supplies ink into the holder 21, a shaft body 11 that internally houses the ink supply section 40, and a tip shaft 12 that is continuously provided at a tip end of the shaft body 11 with the holder 21 projecting out from the tip shaft 12 during writing and the tip shaft 12 exhibiting an elastic action. A second aspect of the present invention is the first aspect, wherein the tip shaft 12 is formed by double molding of a front half 15 and a rear half 16 that are interdigitated with each other in a serrated pattern.

The shaft body 11 may be capable of directly containing ink internally, or may be a structure that internally houses a refill filled with ink. The ink supply section 40 may supply ink contained in the shaft body 11 to the holder 21 using an intermediate member, such as a collector 41, or may supply ink contained in an ink containing tube such as a refill that is a separate body to the shaft body 11 to the holder 21.

The tip end side of the holder 21 is exposed from the tip shaft 12 during writing, and the rear end side of the holder 21 is positioned inside the tip shaft 12 and in communication with the ink supply section 40. A non-illustrated ball housing is formed inside the tip of the holder 21, and the writing ball 30 is gripped by the ball housing. The holder 21 may be formed by machining or injection molding a metal material such as stainless steel, or a resin material such as polyacetal.

According to the present aspects, a writing sensation akin to that of a fountain pen can be obtained due to the double molded portion interdigitated in a serrated pattern flexing according to the force applied during writing. Moreover, the configuration of the ballpoint pen tip 20 and the outer member 60 enables lines of different thicknesses to be drawn using a single writing tip according to the angle of the ballpoint pen tip. Thus because it is possible to finely adjust the angle of the ballpoint pen tip with respect to the writing surface according to the force applied during writing, the thickness of line drawn is variable markedly, enabling an improvement in the expressiveness of writing to be achieved.

Note that the double molding referred to here indicates integrally forming two or more types of component, and encompasses molding using the same materials as each other, and forming a multiplex molding in which components are not adhered to each other.

(Third Aspect)

The third aspect of the present invention is the second aspect in which a joint 50 is double molded. Namely, the tip shaft 12 comprises the joint 50 fixed to the shaft body 11, and an outer member 60 that is fixed to the joint 50 and that covers an outer periphery of the holder 21. The joint 50 is formed by double molding of a front half 15 and a rear half 16 that are interdigitated with each other in a serrated pattern.

According to the present aspect, similarly to the second aspect, because it is possible to finely adjust the angle of the writing tip with respect to the writing surface according to the force applied during writing, the thickness of line drawn is variable markedly, enabling an improvement in the expressiveness of writing to be achieved.

(Fourth Aspect)

A fourth aspect of the present invention is the third aspect, wherein the joint 50 is integrally formed with the outer member 60.

According to the present aspect, similarly to the second aspect, because it is possible to finely adjust the angle of the writing tip with respect to the writing surface according to the force applied during writing, the thickness of line drawn is variable markedly, enabling an improvement in the expressiveness of writing to be achieved.

(Fifth Aspect)

A fifth aspect of the present invention is the third aspect, wherein the joint 50 is integrally formed with the shaft body 11.

According to the present aspect, similarly to the second aspect, because it is possible to finely adjust the angle of the writing tip with respect to the writing surface according to the force applied during writing, the thickness of line drawn is variable markedly, enabling an improvement in the expressiveness of writing to be achieved.

(Sixth Aspect)

A sixth aspect of the present invention includes, in addition to the above features, an internal joint 14 interposed between the ink supply section 40 and the holder 21.

The holder 21 may be directly connected to the ink supply section 40, but interposing the internal joint 14 is particularly advantageous in cases in which there is a large difference in diameter between the holder 21 and the ink supply section 40.

Advantageous Effects of Invention

Being configured as described above, the invention of the present application enables a double molded portion interdigitated in a serrated pattern to be flexed according to the force applied during writing, and enabling a writing sensation akin to that of a fountain pen to be obtained.

Moreover, it is possible to draw lines of different thicknesses using a single writing tip according to the angle of the ballpoint pen tip. Thus the thickness of line drawn can be varied by finely adjusting the angle of the ballpoint pen tip with respect to the writing surface according to the force applied during writing, enabling easier and higher quality writing of a "stop", an "upward tick", and a "sweeping stroke", and enabling an improvement in the expressiveness of writing to be achieved.

DESCRIPTION OF EMBODIMENTS

Explanation follows regarding embodiments of the present invention, split into a first to a sixth exemplary embodiments, with reference to the drawings. Note that in the present specification, "front" with reference to a ballpoint pen 1 and its configuring components means a tip side with a writing ball 30 as the tip of the ballpoint pen 1, and "rear" is the opposite side thereto.

First Exemplary Embodiment

Figure 1A:
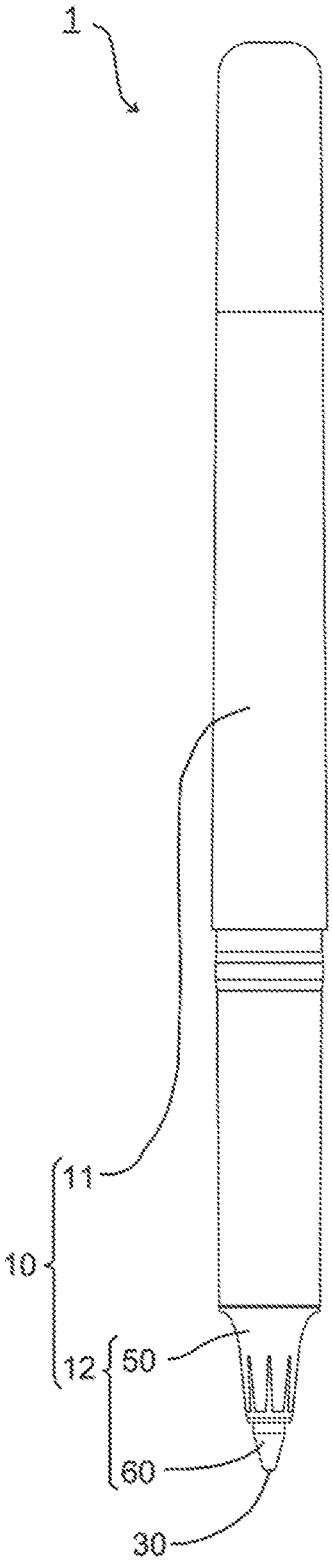
FIG. 1A is a front view of a ballpoint pen of a first exemplary embodiment of the present invention.
Figure 1B:
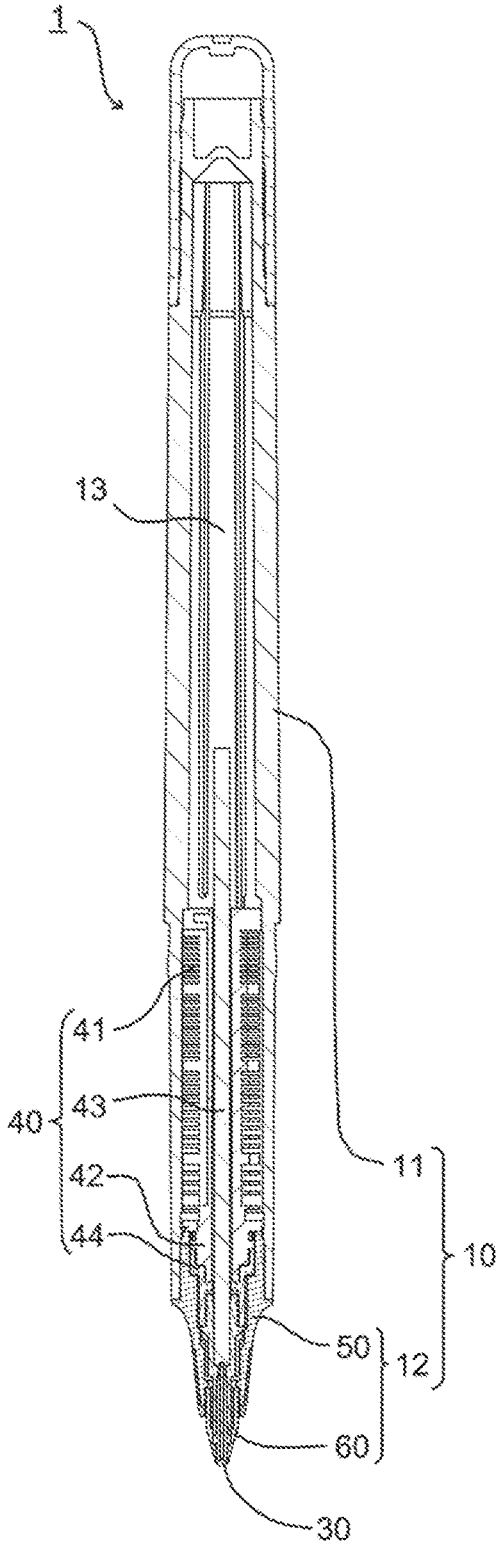
FIG. 1B is a vertical cross-section thereof.
Figure 2:
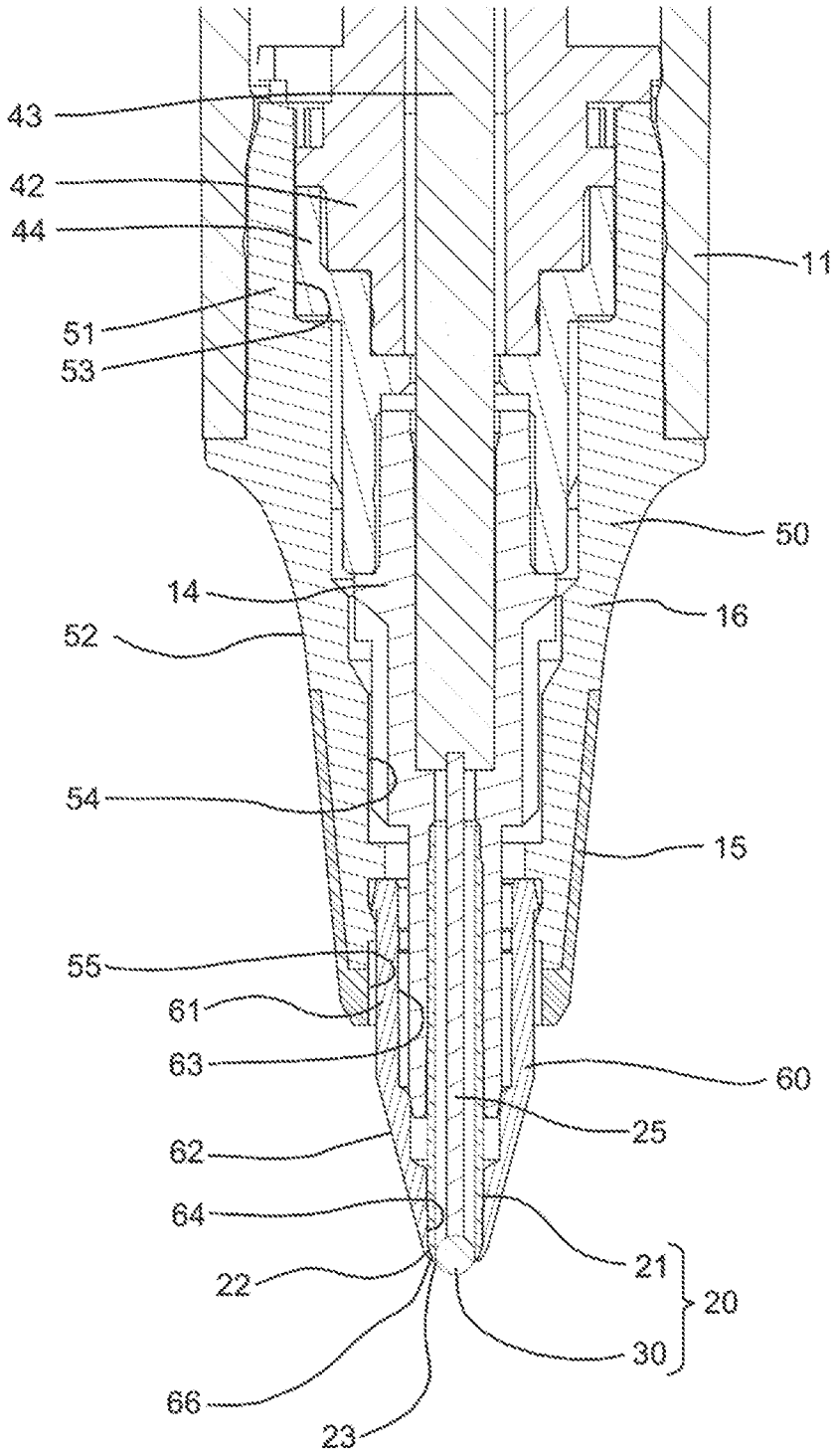
FIG. 2 is a vertical cross-section of a tip portion of a ballpoint pen of the first exemplary embodiment.

FIG. 1A illustrates an external appearance of a ballpoint pen 1 according to a first exemplary embodiment. As illustrated in FIG. 1B and FIG. 2, the ballpoint pen 1 includes a ballpoint pen tip 20, including a writing ball 30 and a holder 21 that retains the writing ball 30 with a swaged section 23 swaged at its tip end, an ink supply section 40 that supplies ink to the holder 21 of the ballpoint pen tip 20, and a shaft 10 that internally houses the ink supply section 40.

As illustrated in FIG. 1B, the shaft 10 comprises a shaft body 11 equipped with an ink housing section 13, and a tip shaft 12 provided at a tip of the shaft body 11. The tip shaft 12 is configured from a joint 50 fixed to a tip portion of the shaft body 11, and an outer member 60 fixed to the joint 50. An internal joint 14 for connecting the ink supply section 40 and the ballpoint pen tip 20 together is installed inside the tip shaft 12. The ink housing section 13 is filled with ink, not illustrated in the drawings.

As illustrated in FIG. 1B, the ink supply section 40 includes a substantially cylindrical shaped collector 41 with plural fins formed around its external periphery, a tip holding portion 42 that is formed with a reduced diameter at a tip of the collector 41, and a tip piece 44 formed from a rubber elastic material and mounted to a tip of the tip holding portion 42. A rear end portion of the collector 41 contacts the ink housing section 13. As illustrated in FIG. 2, the tip holding portion 42 is fitted into a rear internal portion of the tip piece 44, and the internal joint 14 is fitted into a front internal portion of the tip piece 44. A collector core 43 is formed from rod shaped polyester fibers, with its rear end side projecting out inside the ink housing section 13 (see FIG. 1B), with its central portion axially passing through the collector 41, the tip holding portion 42, and the tip piece 44, and with its tip side being inserted through from a rear end portion of the internal joint 14 to a position approximately halfway along the internal joint 14.

As illustrated in FIG. 2, the ballpoint pen tip 20 includes the cylindrical shaped holder 21, and the writing ball 30 retained by the holder 21. A tip end side of the holder 21 is formed with a substantially circular conical shaped tapered portion 22 tapering toward the tip end, and with the swaged section 23, where a tip end edge of the tapered portion 22 is pressed inwards and reduced in diameter. A tip end portion of the writing ball 30 that is gripped inside the tapered portion 22 is exposed through a tip end edge of the swaged section 23. The holder 21 may be formed by processing a pipe member made from a metal such as stainless steel, or from a resin such as polyacetal. A rod shaped central core 25 is inserted inside the holder 21 and projects out from a rear end portion of the holder 21. The central core 25 is, similarly to the collector core 43, formed from polyester fibers. A rear end of the central core 25 is fitted into a tip end portion of the collector core 43, and a tip end of the central core 25 reaches just behind the writing ball 30. The central core 25 sucks in ink that has permeated into the collector core 43, and supplies the ink to the writing ball 30. The ballpoint pen tip 20 is retained by the internal joint 14 in a state in which approximately two-thirds of a rear end part of the ballpoint pen tip 20 is fitted into the internal joint 14.

The collector core 43 and the central core 25 are formed by selecting polyester fibers of appropriate porosity and surface profile according to characteristics of the ink being employed, such as the viscosity.

The joint 50 is a component made from a synthetic resin, and configured with a cylindrical shaped joint fixing portion 51, and a substantially circular conical shaped joint tapered portion 52 continuously provided to the joint fixing portion 51. A hole is formed through from a rear end toward a tip end of the joint 50, with a rear insertion hole 53 provided at an inner face of the joint fixing portion 51, a central insertion hole 54 with a smaller diameter than that of the rear insertion hole 53 provided at an inner face in the vicinity of a center of the joint tapered portion 52, and a front insertion hole 55 with a diameter substantially the same as that of the central insertion hole 54 provided at the inner face in the vicinity of a tip end of the joint tapered portion 52.

Figure 3A:
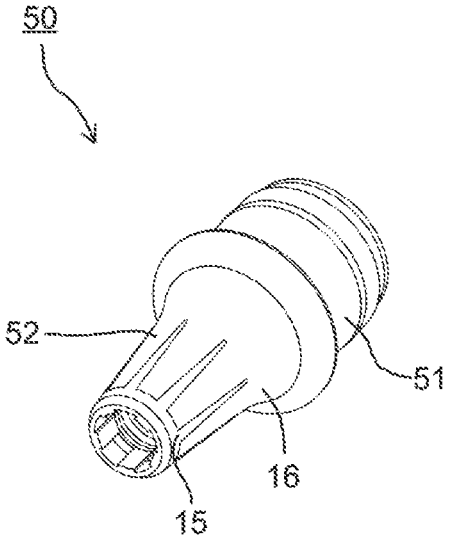
FIG. 3A is a perspective view of a joint employed in a ballpoint pen of the first exemplary embodiment.
Figure 3B:
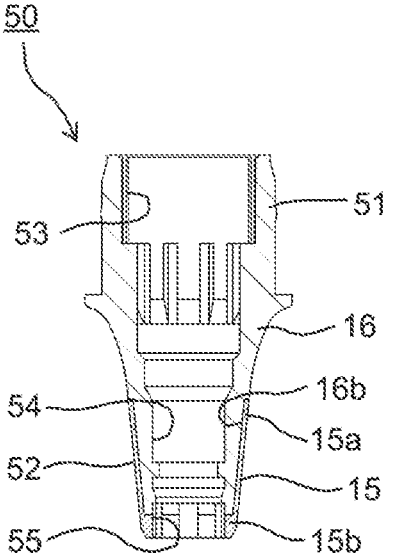
FIG. 3B is a vertical cross-section thereof.

The joint 50 is a component formed by double molding, and, as illustrated in FIG. 3A and FIG. 3B, the joint 50 is formed such that a rear half 16, as a primary molding body, and a front half 15, as a secondary molding body, are interdigitated with each other in a serrated pattern. The rear half 16 is configured by a portion from a rear end of the joint fixing portion 51 over approximately one-third of a rear side of the front insertion hole 55, and by rear half indentations 16*b* spanning from the tip end of that portion to substantially the center of the joint tapered portion 52 at eight evenly disposed external peripheral locations. Rear half projections 16*a* are formed between adjacent of the rear half indentations 16*b*. The front half 15 is configured by a ring shaped portion 15*b* that is a portion from the tip end of the joint tapered portion 52 over approximately two-thirds of a front side of the front insertion hole 55, and by front half projections 15*a* that extend rearward from the ring shaped portion 15*b*, so as to correspond to the rear half indentations 16*b*. The front half 15 and the rear half 16 are integrated together by joining such that the rear half projections 16*a*, and the front half projections 15*a* for fitting into the rear half indentations 16*b*, are mutually aligned so as to interdigitate with each other.

In order to obtain flexing, although it is desirable to employ a thermoplastic elastomer for the front half 15, as the secondary molding body, the same material may be employed as that of the rear half 16, as the primary molding body.

As illustrated in FIG. 1B and FIG. 2, the ink supply section 40 and the internal joint 14 that fits into the ink supply section 40 are inserted into the joint 50 from its rear. Herein, the tip piece 44 fits into the rear insertion hole 53, and the internal joint 14 is inserted into the central insertion hole 54. The joint 50 is fixed to the shaft body 11 by the joint fixing portion 51 fitting into an inner face in the vicinity of a tip end of the shaft body 11.

Figure 4:
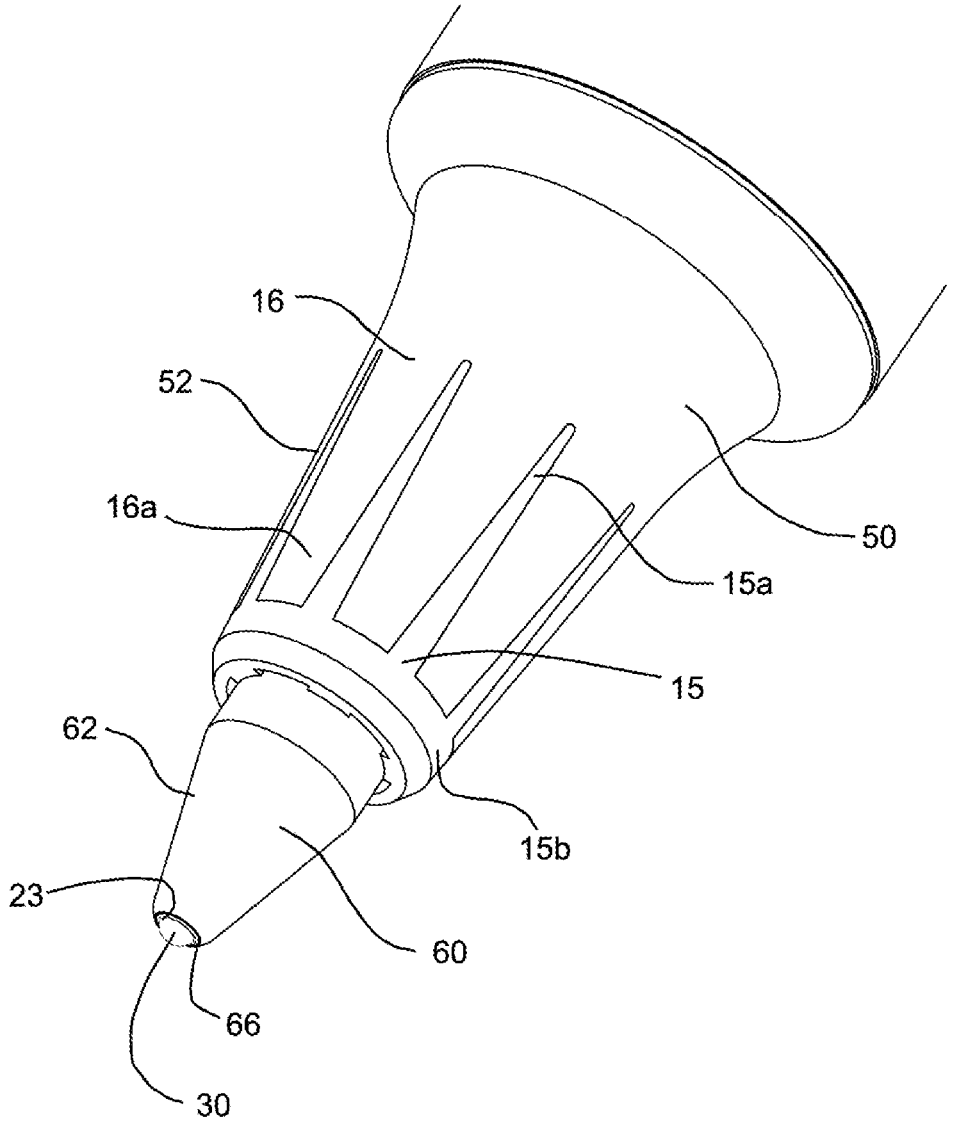
FIG. 4 is perspective view of a tip shaft of a ballpoint pen of the first exemplary embodiment.

The outer member 60 is, as illustrated in FIG. 2, a synthetic resin component configured by a cylindrical shaped outer fixing portion 61, and a substantially circular conical shaped outer tapered portion 62 continuously provided at the outer fixing portion 61. A beveled outer tip portion 66 is provided at a tip end of the outer tapered portion 62. A hole is formed through from a rear end toward a tip end of the outer member 60, with a rear insertion hole 63 provided at an inner face of the outer fixing portion 61, and a front insertion hole 64 of a smaller diameter than the rear insertion hole 63 provided at an inner face in the vicinity of the tip end of the outer tapered portion 62. The outer fixing portion 61 is fixed to the joint 50 by being fitted into the front insertion hole 55 of the joint 50. The outer member 60 covers the ballpoint pen tip 20. Herein, a tip end portion of the internal joint 14 is inserted into the rear insertion hole 63, and the ballpoint pen tip 20 projecting out from the internal joint 14 is fitted into the front insertion hole 64. As illustrated in FIG. 4, only the writing ball 30, the swaged section 23 covering the writing ball 30, and the outer tip portion 66 are exposed in the vicinity of the tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer tip portion 66.

The ballpoint pen 1 has a structure in which the joint 50 readily flexes by deformation in the vicinity of a joint portion between the front half 15 and the rear half 16. This enables the outer member 60 to be tilted from a central axis of the shaft body 11 according to the force applied during writing. This enables a writing sensation akin to that of a fountain pen to be obtained.

If the writing ball 30 and the outer tip portion 66 contact the writing surface due to the outer member 60 tilting from the central axis of the shaft body 11, ink adhering to a surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing of the joint 50.

Second Exemplary Embodiment

Figure 5A:
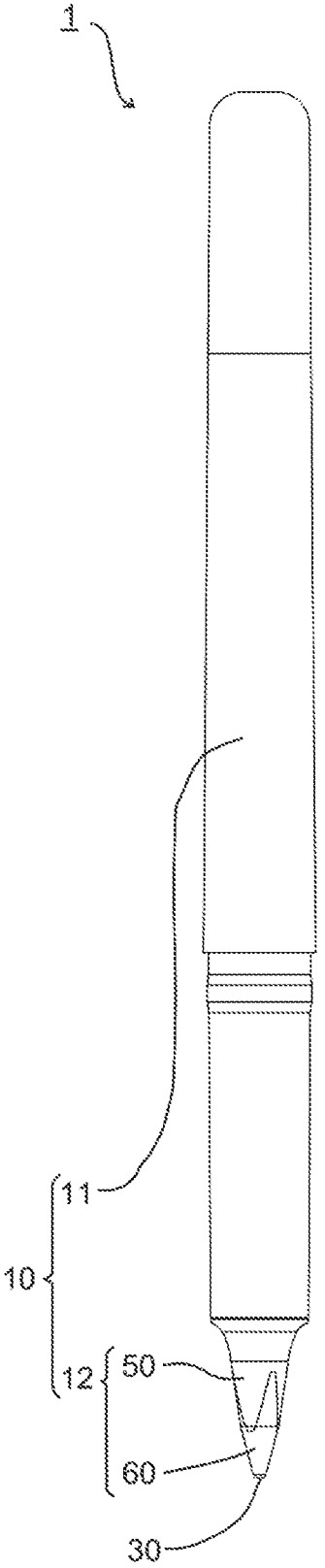
FIG. 5A is a front view of a ballpoint pen of a second exemplary embodiment of the present invention.

FIG. 5A illustrates an external appearance of a ballpoint pen 1 according to a second exemplary embodiment. The second exemplary embodiment is one in which a joint 50 and an outer member 60 are integrally formed. Note that the second exemplary embodiment differs from the first exemplary embodiment in a structure of a tip shaft 12, but is otherwise similar to the first exemplary embodiment, and so explanation will only be given to different points.

Figure 6:
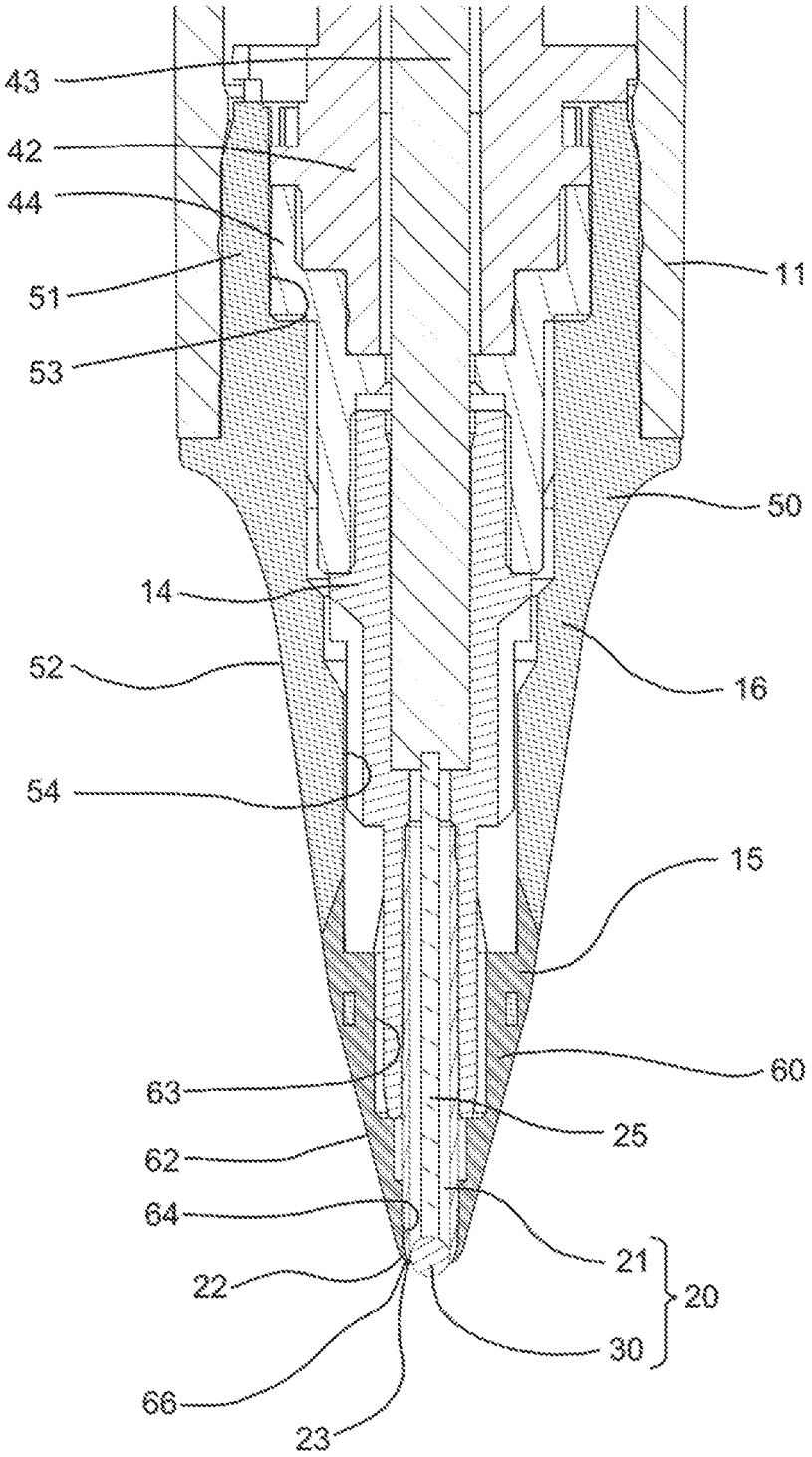
FIG. 6 is a vertical cross-section of a tip portion of a ballpoint pen of the second exemplary embodiment.

The joint 50 and the outer member 60 are components made from synthetic resin. As illustrated in FIG. 6, the joint 50 is configured by a cylindrical shaped joint fixing portion 51, and a truncated circular conical shaped joint tapered portion 52 continuously provided to the joint fixing portion 51. The outer member 60 is juxtaposed to the joint tapered portion 52, and is configured by a substantially circular conical shaped outer tapered portion 62 having a larger taper angle than the joint tapered portion 52. A hole is formed through from a rear end toward a tip end of the joint 50, with a rear insertion hole 53 provided at an inner face of the joint fixing portion 51, and a central insertion hole 54 of a smaller diameter than the rear insertion hole 53 provided at an inner face in the vicinity of a tip end of the joint tapered portion 52. A hole continuing from the joint 50 is formed in the outer member 60, with a rear insertion hole 63 of a smaller diameter than the central insertion hole 54 is provided at an inner face in the vicinity of a rear end of the outer tapered portion 62, and a front insertion hole 64 of a smaller diameter than the rear insertion hole 63 is provided at the inner face in the vicinity of a tip end of the outer tapered portion 62. A beveled outer tip portion 66 is provided at the tip end of the outer tapered portion 62.

Figure 7A:
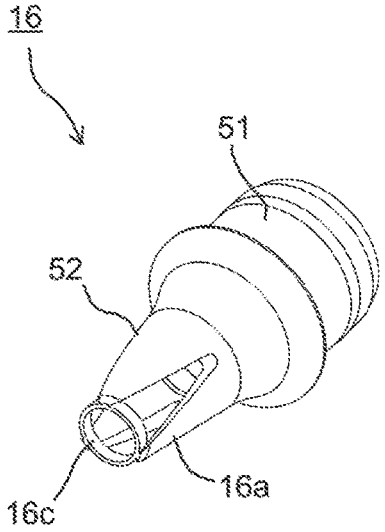
FIG. 7A is a perspective view of a joint and a rear half of an outer member employed in a ballpoint pen of the second exemplary embodiment.
Figure 7B:
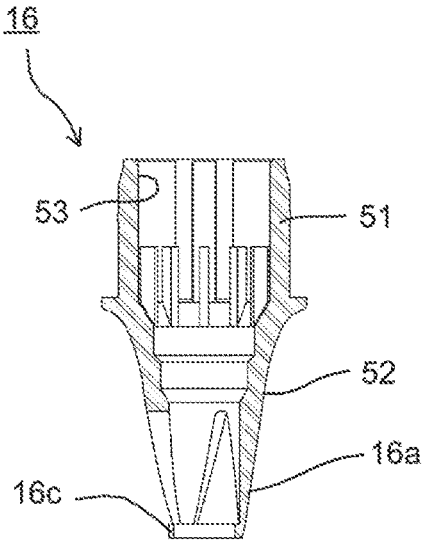
FIG. 7B is a vertical cross-section thereof.
Figure 8A:
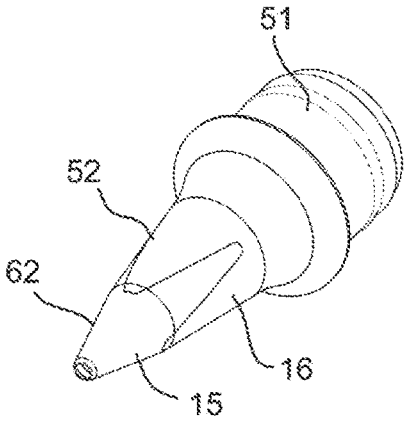
FIG. 8A is a perspective view of a joint and an outer member employed in a ballpoint pen of the second exemplary embodiment.
Figure 8B:
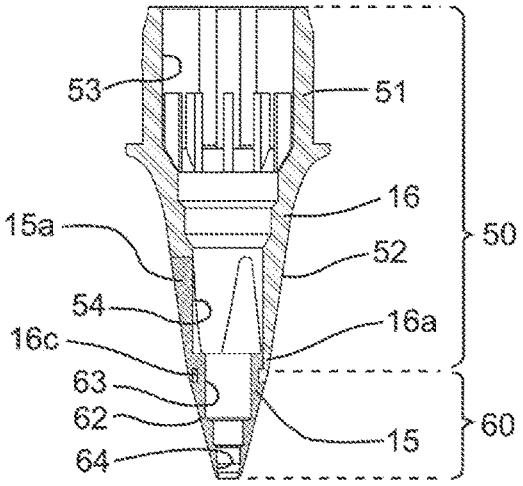
FIG. 8B is a vertical cross-section thereof.

Moreover, the joint 50 and the outer member 60 are components formed by double molding, and are formed such that a rear half 16, as a primary molding body, and a front half 15, as a secondary molding body, are interdigitated with each other in a serrated pattern. As illustrated in FIG. 7A and FIG. 7B, the rear half 16 is configured by a portion from a rear end of the joint fixing portion 51 over approximately half of a rear side of the joint tapered portion 52, by rear half projections 16*a* extending from a position at substantially half the way along the joint tapered portion 52 toward the tip end of the joint tapered portion 52 at three evenly disposed locations with respect to a central axis, and by a ring portion 16*c* formed in a ring shape at a tip end of the rear half projections 16*a*. As illustrated in FIG. 8A and FIG. 8B, the front half 15 is configured by the outer tapered portion 62 and by front half projections 15*a* that extend from the vicinity of a rear end of the outer tapered portion 62 toward a position substantially half way along the joint tapered portion 52, at three evenly disposed locations with respect to the central axis. The front half 15 and the rear half 16 are integrated together by joining together such that the rear half projections 16*a*, and the front half projections 15*a* are mutually aligned so as to interdigitate with each other. The ring portion 16*c* is inserted inside the front half 15 in a configuration such that the rear half 16 does not fall out from the front half 15 even though the front half 15 and the rear half 16 are formed by double molding without being adhered to each other.

Note that flexing of the front half 15, as the secondary molding body, can be obtained even when molded from similar material to that of the rear half 16, as the primary molding body.

Figure 5B:
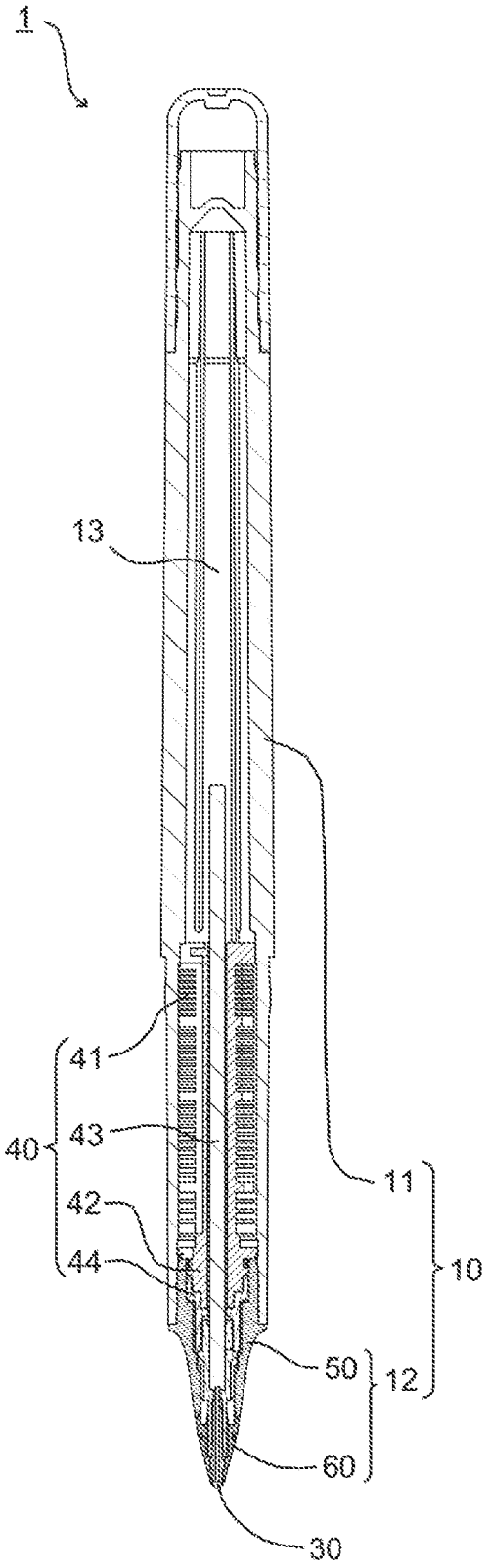
FIG. 5B is a vertical cross-section thereof.

As illustrated in FIG. 5B and FIG. 6, the ink supply section 40 and an internal joint 14 that fits into the ink supply section 40 are inserted into the joint 50 from its rear. Herein, a tip piece 44 fits into the rear insertion hole 53, and the internal joint 14 is inserted into the central insertion hole 54 and the rear insertion hole 63. A ballpoint pen tip 20 that projects out from the internal joint 14 is inserted into the front insertion hole 64. The joint 50 is fixed to a shaft body 11 by the joint fixing portion 51 fitting into an inner face in the vicinity of a tip end of the shaft body 11.

Figure 9:
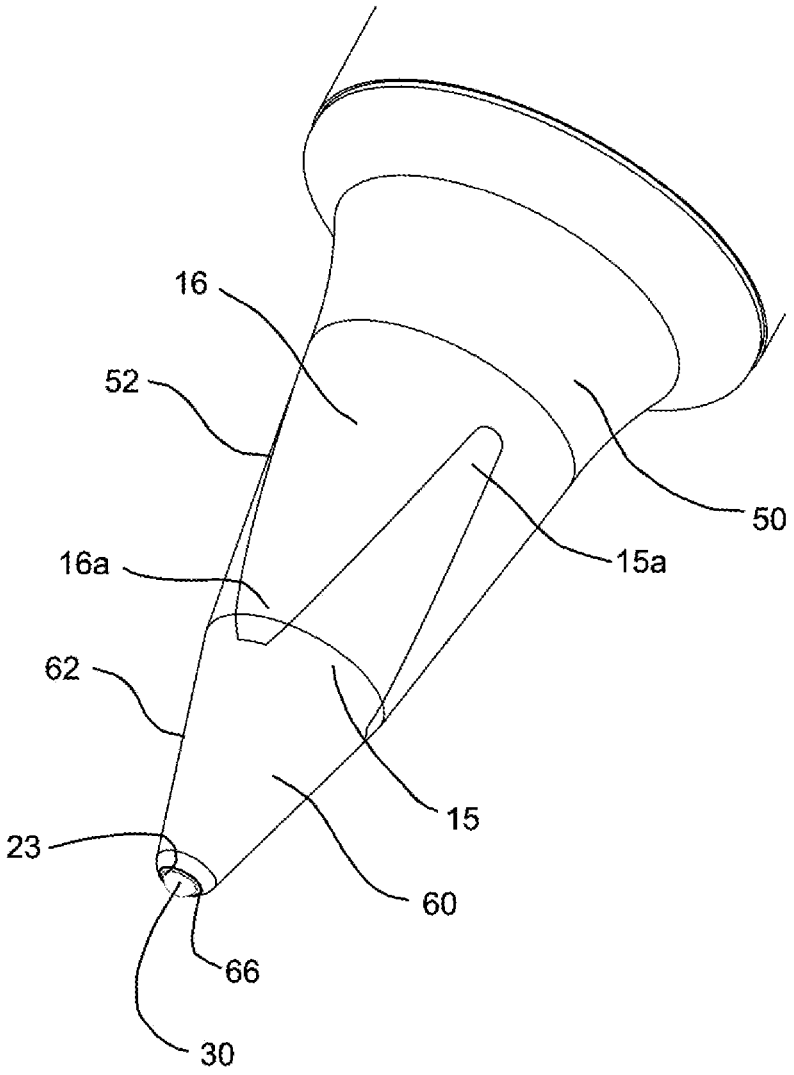
FIG. 9 is a perspective view of a tip shaft of a ballpoint pen of the second exemplary embodiment.

A tip end portion of the outer member 60 covers the ballpoint pen tip 20. As illustrated in FIG. 9, only a writing ball 30, a swaged section 23 covering the writing ball 30, and the outer tip portion 66 are exposed in the vicinity of a tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer tip portion 66.

The ballpoint pen 1 has a structure in which the joint 50 and the outer member 60, which are integrally formed, readily flex by deformation in the vicinity of a joint portion between the front half 15 and the rear half 16. This enables the front half 15 to be tilted from a central axis of the shaft body 11 according to the force applied during writing. This enables a writing sensation akin to that of a fountain pen to be obtained.

Moreover, if the writing ball 30 and the outer tip portion 66 contact the writing surface due to the outer member 60 being tilted from the central axis of the shaft body 11, ink adhering to a surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing of the joint 50.

Third Exemplary Embodiment

Figure 10A:
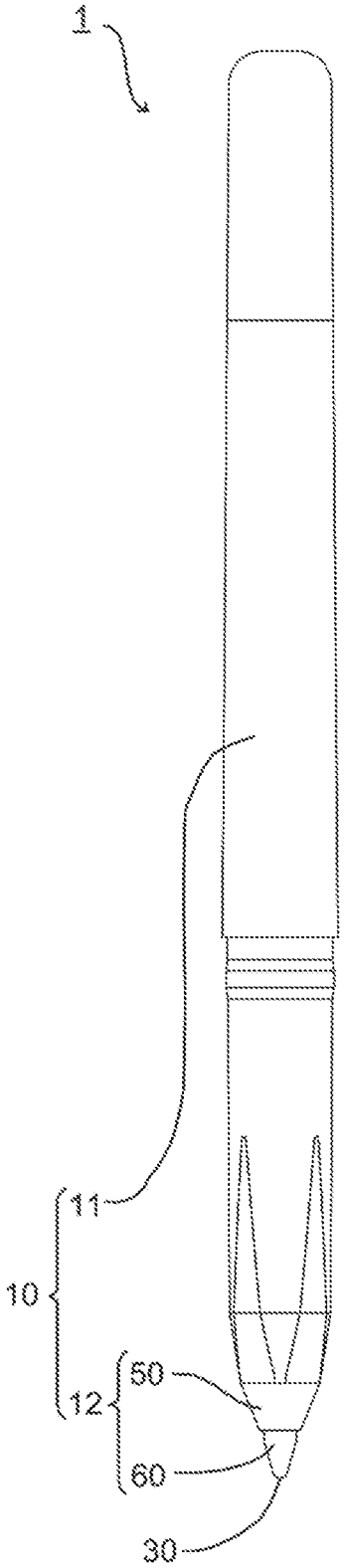
FIG. 10A is a front view of a ballpoint pen of a third exemplary embodiment of the present invention.

FIG. 10A illustrates an external appearance of a ballpoint pen 1 according to a third exemplary embodiment. In the third exemplary embodiment, the joint 50 and the shaft body 11 are integrally formed. Note that the third exemplary embodiment differs from the first exemplary embodiment in a structure of a tip shaft 12, but is otherwise similar to the first exemplary embodiment, and so explanation will only be given to different points.

Figure 11:
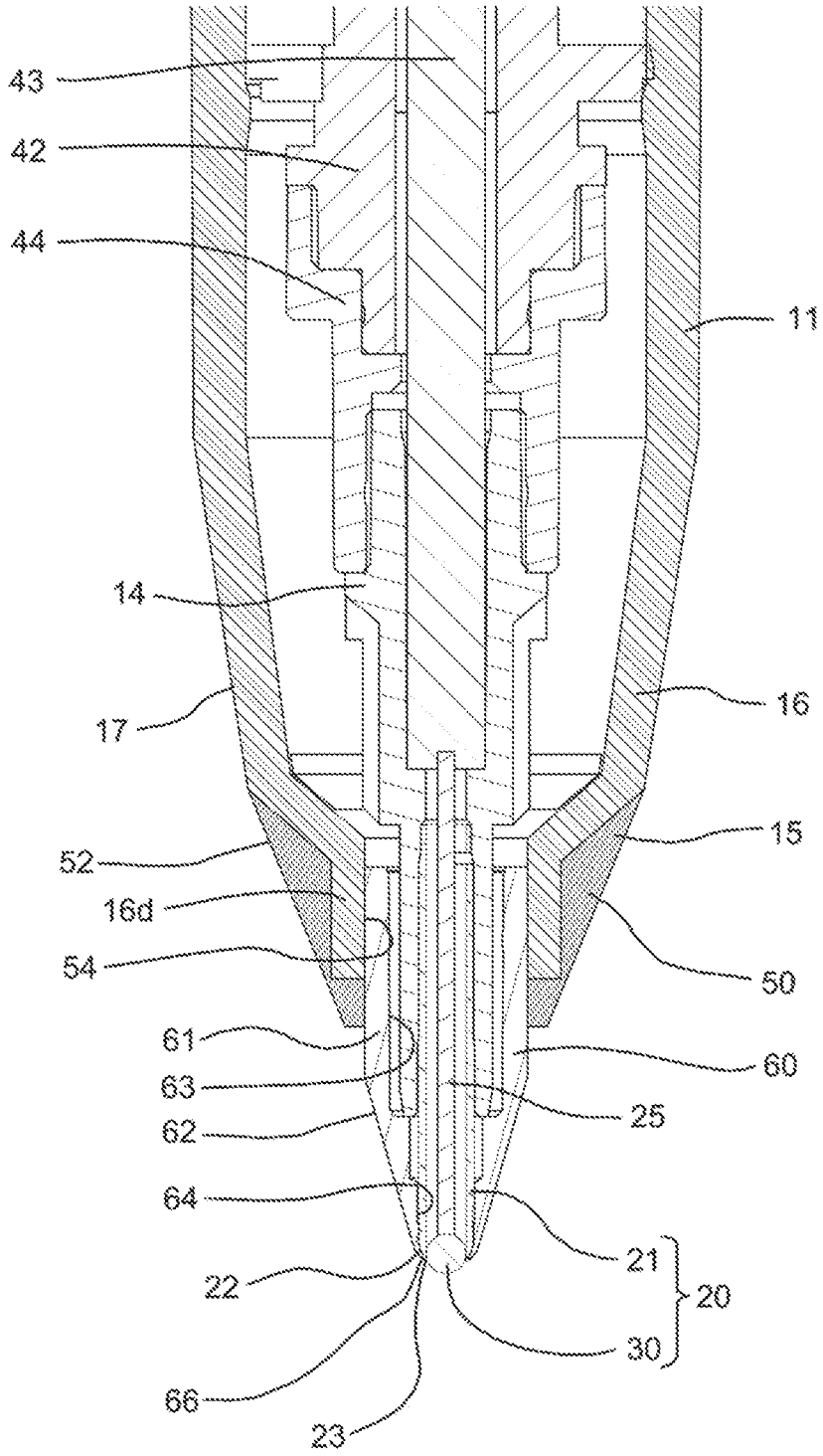
FIG. 11 is a vertical cross-section of a tip portion of a ballpoint pen of the third exemplary embodiment.

The joint 50 and the shaft body 11 are components made from synthetic resin and, as illustrated in FIG. 11, are configured by a shaft tapered portion 17 formed at a tip end portion of the shaft body 11, and by a substantially circular conical shaped joint tapered portion 52 juxtaposed to the shaft tapered portion 17 and having a larger taper angle than the shaft tapered portion 17. A central insertion hole 54 is formed at an inner face of the joint tapered portion 52.

Figure 12:
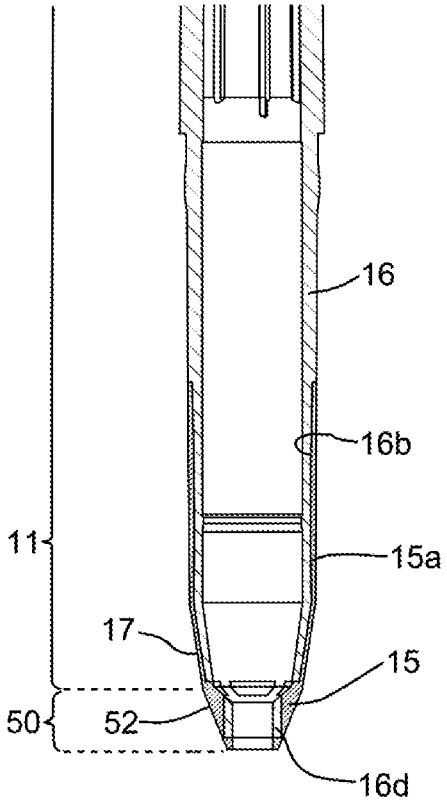
FIG. 12 is a vertical cross-section of a shaft body and a joint employed in a ballpoint pen of the third exemplary embodiment.
Figure 13:
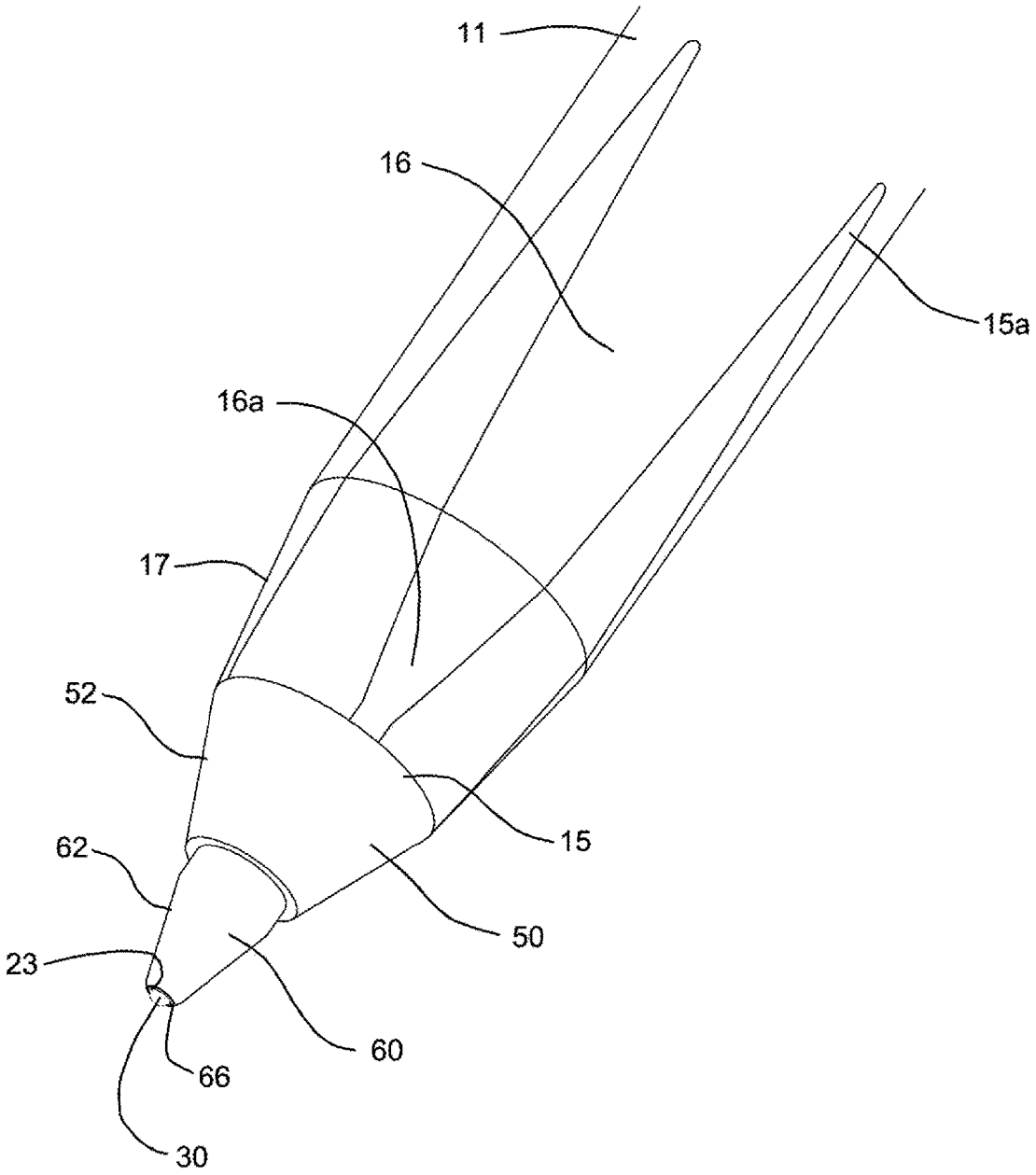
FIG. 13 is a perspective view of a tip shaft of a ballpoint pen of the third exemplary embodiment.

Moreover, the joint 50 and the shaft body 11 are components formed by double molding, and, as illustrated in FIG. 12 and FIG. 13, a rear half 16, as a primary molding body, and a front half 15, as a secondary molding body, are interdigitated with each other in a serrated pattern. The rear half 16 is configured by a portion of the shaft body 11 behind the shaft tapered portion 17, by a tube shaped connection portion 16*d* continuously provided at a tip end of the shaft tapered portion 17, and by rear half indentations 16*b* spanning over approximately one-fifth of a front of the shaft body 11 from the tip end of the shaft tapered portion 17 at four evenly disposed peripheral locations. Rear half projections 16*a* are configured between adjacent of the rear half indentations 16*b*. The front half 15 is configured by the joint tapered portion 52, and by front half projections 15*a* that extend rearward from a rear end of the joint tapered portion 52, and that are formed so as to correspond to the rear half indentations 16*b*. The front half 15 and the rear half 16 are integrated together by joining together such that the rear half projections 16*a*, and the front half projections 15*a* accommodated in the rear half indentations 16*b* are mutually aligned so as to interdigitate with each other.

Note that, in order to obtain flexing, the front half 15, as the secondary molding body, preferably employs a rubber elastic material such as a thermoplastic elastomer, but a similar material may be employed to that of the rear half 16, as the primary molding body, as long as it is a material of low hardness.

Figure 10B:
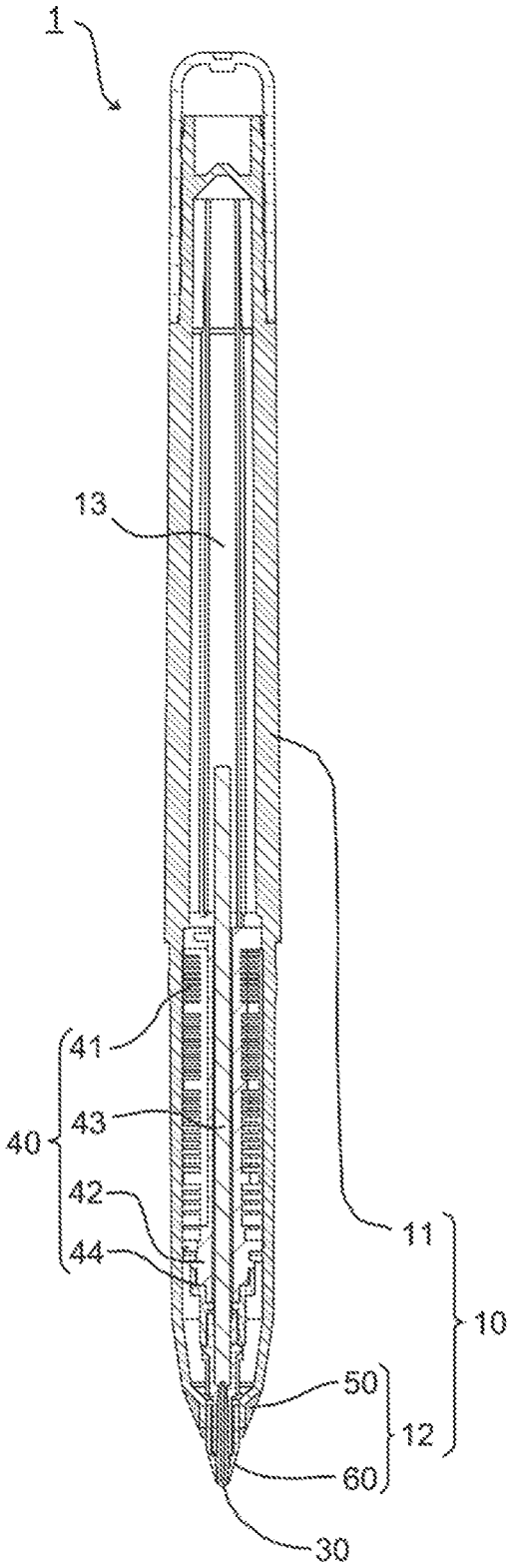
FIG. 10B is a vertical cross-section thereof.

As illustrated in FIG. 10B and FIG. 11, an ink supply section 40 and an internal joint 14 that fits into the ink supply section 40 are inserted into the joint 50 from its rear. Herein, the internal joint 14 is inserted into the central insertion hole 54.

An outer member 60 is, as illustrated in FIG. 11, a component made from synthetic resin and configured by a cylindrical shaped outer fixing portion 61 and a substantially circular conical shaped outer tapered portion 62 continuously provided to the outer fixing portion 61. A beveled outer tip portion 66 is provided at a tip end of the outer tapered portion 62. A hole is formed through from a rear end toward a tip end of the outer member 60, with a rear insertion hole 63 provided at an inner face of the outer fixing portion 61, and a front insertion hole 64 of a smaller diameter than the rear insertion hole 63 provided at an inner face in the vicinity of the tip end of the outer tapered portion 62. The outer fixing portion 61 is fixed to the joint 50 by fitting into the central insertion hole 54 of the joint 50. The outer member 60 covers a ballpoint pen tip 20. Herein, a tip end portion of the internal joint 14 is inserted into the rear insertion hole 63, and the ballpoint pen tip 20 projecting out from the internal joint 14 is fitted into the front insertion hole 64. As illustrated in FIG. 13, only a writing ball 30, a swaged section 23 covering the writing ball 30, and the outer tip portion 66 are exposed in the vicinity of the tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer tip portion 66.

The ballpoint pen 1 has a structure in which the front of the shaft body 11 and the joint 50 readily flex by deformation in the vicinity of a joint portion between the front half 15 and the rear half 16. This enables the outer member 60 to be tilted from a central axis of the shaft body 11 according to the force applied during writing. This enables a writing sensation akin to that of a fountain pen to be obtained.

Moreover, if the writing ball 30 and the outer tip portion 66 contact the writing surface due to the outer member 60 being tilted from the central axis of the shaft body 11, ink adhering to the surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing of the joint 50.

Fourth Exemplary Embodiment

Figure 14A:
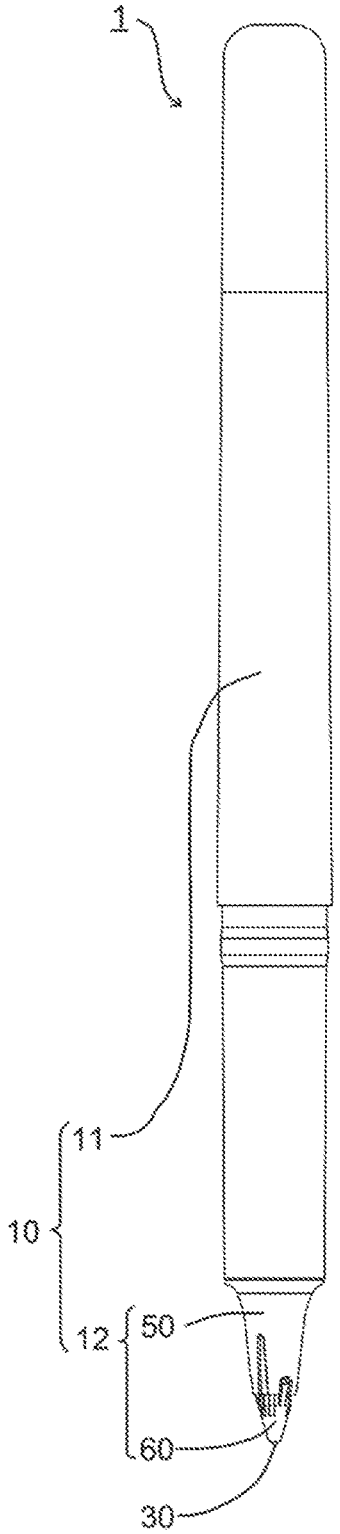
FIG. 14A is a front view of a ballpoint pen of a fourth exemplary embodiment of the present invention.

FIG. 14A illustrates an external appearance of a ballpoint pen 1 according to a fourth exemplary embodiment. The ballpoint pen 1 is, as illustrated in FIG. 14B and FIG. 15, equipped with a ballpoint pen tip 20 including a writing ball 30 and a holder 21 retaining the writing ball 30 with a swaged section 23 swaged at its tip end, an ink supply section 40 that supplies ink to the holder 21 of the ballpoint pen tip 20, and a shaft 10 that internally houses the ink supply section 40.

Figure 14B:
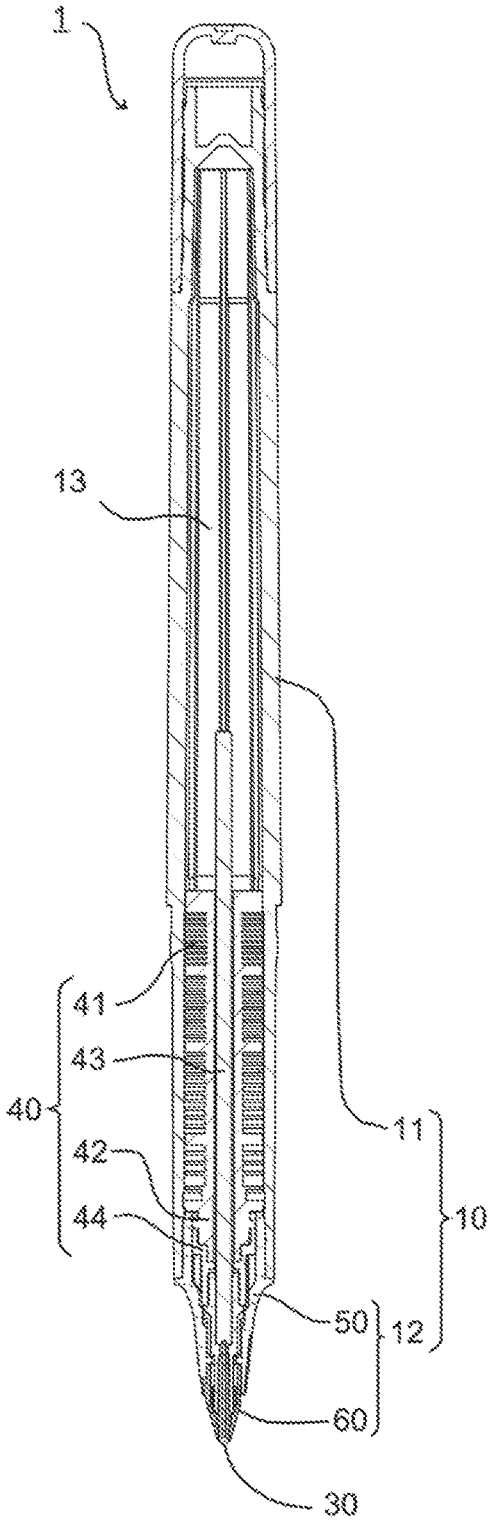
FIG. 14B is a vertical cross-section thereof.

As illustrated in FIG. 14B, the shaft 10 is configured by a shaft body 11 equipped with an ink housing section 13, and a tip shaft 12 provided at a tip end of the shaft body 11. The tip shaft 12 comprises a joint 50 fixed at the tip end of the shaft body 11, and an outer member 60 fixed to the joint 50. An internal joint 14 connecting the ink supply section 40 and the ballpoint pen tip 20 together is installed inside the tip shaft 12. Moreover, non-illustrated ink fills the ink housing section 13.

As illustrated in FIG. 14B, the ink supply section 40 includes a substantially tube shaped collector 41 with plural fins formed around its external periphery, a tip holding portion 42 that is formed with reduced diameter at a tip of the collector 41, and a tip piece 44 formed from a rubber elastic material and mounted to a tip of the tip holding portion 42. A rear end portion of the collector 41 contacts the ink housing section 13. As illustrated in FIG. 15, the tip holding portion 42 is fitted into a rear internal portion of the tip piece 44, and the internal joint 14 is fitted into a front internal portion of the tip piece 44. A collector core 43 is formed from rod shaped polyester fibers, with a rear end side of the collector core 43 projecting out inside the ink housing section 13 (see FIG. 14B), with a central portion of the collector core 43 axially passing through the collector 41, the tip holding portion 42, and the tip piece 44. A tip side of the collector core 43 inserted through from a rear end portion of the internal joint 14 to a position approximately halfway along the internal joint 14.

Figure 15:
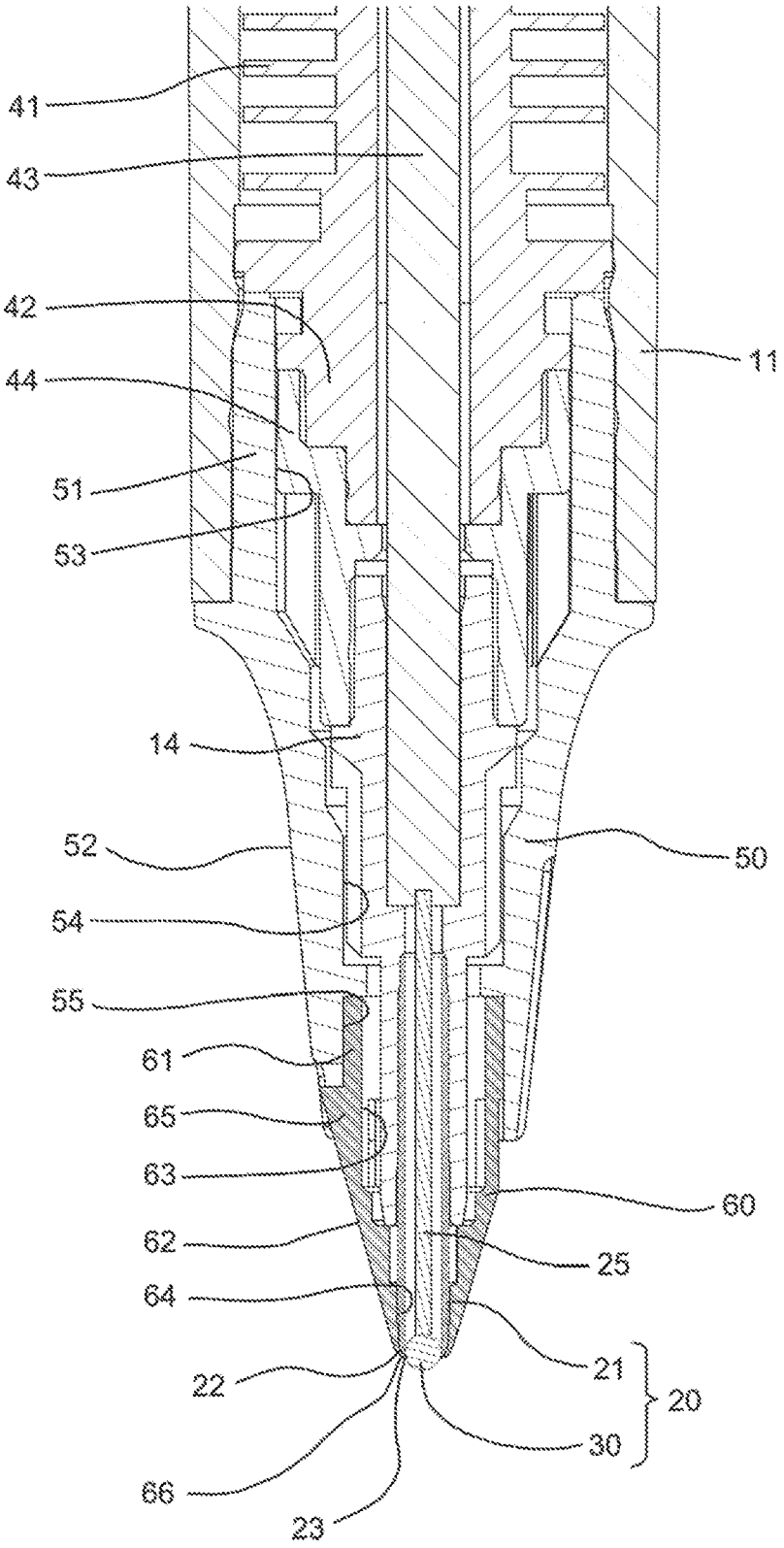
FIG. 15 is a vertical cross-section of a tip portion of a ballpoint pen of the fourth exemplary embodiment.

As illustrated in FIG. 15, the ballpoint pen tip 20 includes the cylindrical shaped holder 21, and the writing ball 30 retained by the holder 21. A tip end side of a holder 21 is formed with a substantially circular conical shaped tapered portion 22 tapering toward its tip end, and with the swaged section 23, where a tip end edge of the tapered portion 22 is pressed inwards and reduced in diameter. A tip end portion of the writing ball 30 that is gripped inside the tapered portion 22 is exposed through a tip end edge of the swaged section 23. The holder 21 may be formed by processing a pipe member made from a metal such as stainless steel, or from a resin such as polyacetal. A rod shaped central core 25 is inserted inside the holder 21 and projects out from a rear end portion of the holder 21. The central core 25 is, similarly to the collector core 43, formed from polyester fibers. A rear end of the central core 25 is fitted into a tip end portion of the collector core 43, and a tip end of the central core 25 reaches just behind the writing ball 30. The central core 25 sucks in ink that has permeated into the collector core 43, and supplies the ink to the writing ball 30. The ballpoint pen tip 20 is retained by the internal joint 14 in a state in which approximately two-thirds of a rear end side of the ballpoint pen tip 20 is fitted into the internal joint 14.

The collector core 43 and the central core 25 are formed by selecting polyester fibers of appropriate porosity and surface profile according to characteristics of the ink being employed, such as the viscosity.

Figure 17:
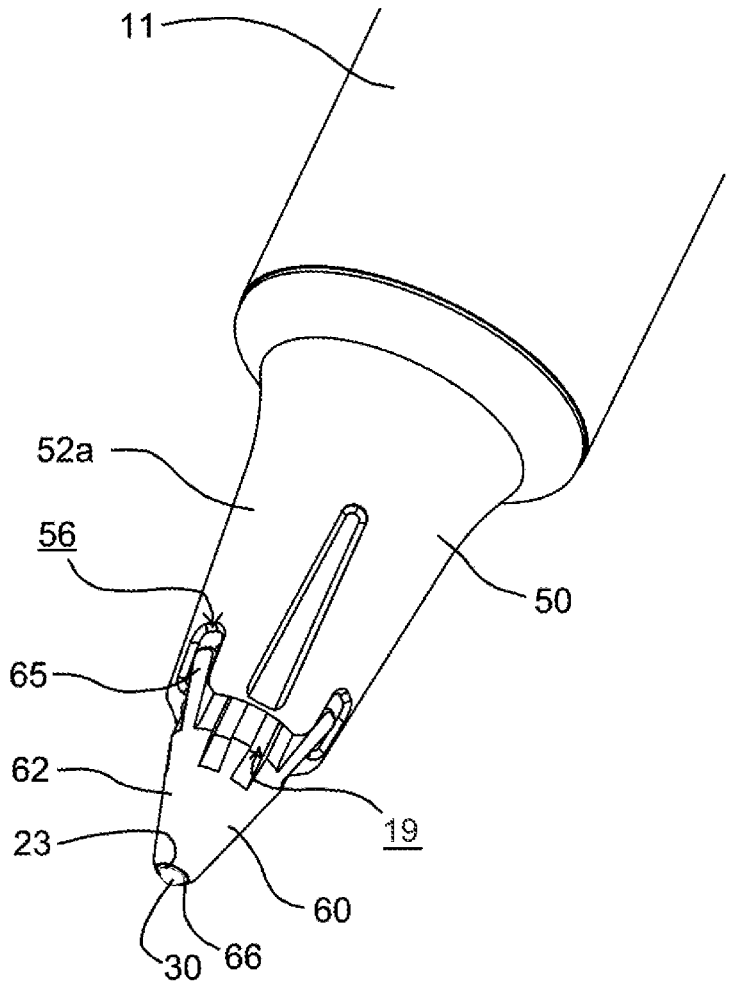
FIG. 17 is a perspective view of a tip shaft of ballpoint pen of the fourth exemplary embodiment.

The joint 50 is a component made from a synthetic resin, and is configured with a cylindrical shaped joint fixing portion 51, and a substantially circular conical shaped joint tapered portion 52 provided continuously to the joint fixing portion 51. As illustrated in FIG. 15, a hole is formed through from a rear end toward a tip end of the joint 50, with a rear insertion hole 53 provided at an inner face of the joint fixing portion 51, and a central insertion hole 54 with a smaller diameter than that of the rear insertion hole 53 provided at an inner face in the vicinity of a center of the joint tapered portion 52. A front insertion hole 55 with a diameter substantially the same as that of the central insertion hole 54 is provided at the inner face in the vicinity of a tip end of the joint tapered portion 52. Moreover, as illustrated in FIG. 17, openings 56 are disposed evenly at three locations at a tip end edge of the joint 50.

As illustrated in FIG. 14B and FIG. 15, the ink supply section 40 and the internal joint 14 that fits into the ink supply section 40 are inserted into the joint 50 from its rear. Herein, the tip piece 44 fits into the rear insertion hole 53, and the internal joint 14 is inserted into the central insertion hole 54. The joint 50 is fixed to the shaft body 11 by the joint fixing portion 51 fitting into an inner face in the vicinity of the tip end of the shaft body 11.

Figure 16A:
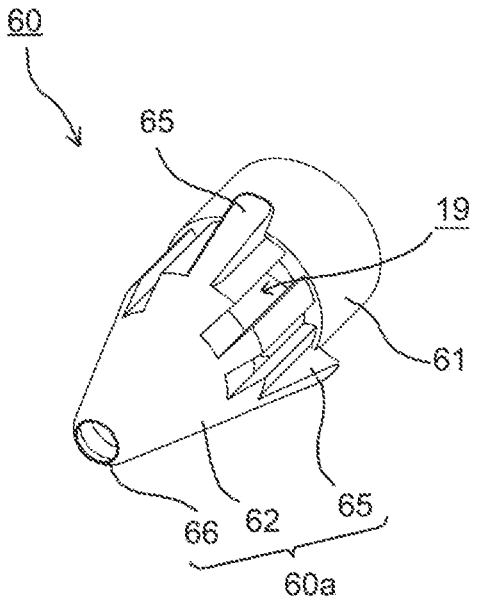
FIG. 16A is a perspective view of an outer member employed in a ballpoint pen of the fourth exemplary embodiment.
Figure 16B:
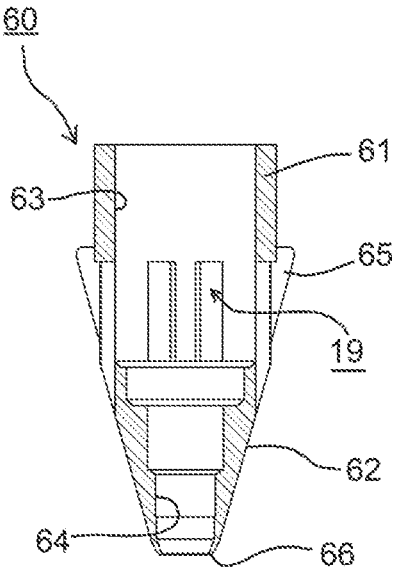
FIG. 16B is a vertical cross-section thereof.

The outer member 60 is, as illustrated in FIG. 15, FIG. 16A, and FIG. 16B, a synthetic resin component configured by a cylindrical shaped outer fixing portion 61, and a substantially circular conical shaped exposed portion 60*a* occupying a tip end side from the outer fixing portion 61 and being externally visible. A tip end side of the exposed portion 60*a* is formed as an outer tapered portion 62, and a beveled outer tip portion 66 is provided to a tip end of the outer tapered portion 62. Three projections 65 spanning from a rear end of the outer tapered portion 62 to a tip end of the outer fixing portion 61 are evenly placed in a pattern radiating out from a central axis at a rear end side of the exposed portion 60*a*. As illustrated in FIG. 17, the projections 65 are inserted inside corresponding openings 56 of the joint 50. Moreover, at positions approximately one-third of the way from a rear end side of the outer tapered portion 62, slits 19 are formed at two locations each at portions on either side of the projections 65 in a pattern radiating out from the central axis in a total of six locations. A hole is formed through from a rear end toward a tip end of the outer member 60, with a rear insertion hole 63 provided at an inner face of the outer fixing portion 61, and a front insertion hole 64 of a smaller diameter than the rear insertion hole 63 provided at an inner face in the vicinity of the tip end of the outer tapered portion 62. The outer fixing portion 61 is fixed to the joint 50 by being fitted into the front insertion hole 55 of the joint 50. The outer member 60 covers the ballpoint pen tip 20. Herein, a tip end portion of the internal joint 14 is inserted into the rear insertion hole 63, and the ballpoint pen tip 20 projecting out from the internal joint 14 is fitted into the front insertion hole 64. As illustrated in FIG. 17, only the writing ball 30, the swaged section 23 covering the writing ball 30, and the outer tip portion 66 are exposed in the vicinity of the tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer lip portion 66.

The ballpoint pen 1 has a structure that readily flexes in the vicinity of the slits 19, thereby enabling a tip end portion of the outer member 60 to be tilted from the central axis of the shaft body 11 according to the force applied during writing. This enables a writing sensation akin to that of a fountain pen to be obtained.

If the writing ball 30 and the outer tip portion 66 contact the writing surface due to the tip end portion of the outer member 60 tilting from the central axis of the shaft body 11, ink adhering to a surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing in the vicinity of the slits 19.

Moreover, by flexing in the vicinity of the slits 19 according to the force applied to the writing tip, the projections 65 on an external peripheral face move in the flexed direction inside the openings 56 into which they are inserted. Thus flexing in the vicinity of the slits 19 is visible to a user of the ballpoint pen 1 from the movement of the projections 65.

Fifth Exemplary Embodiment

Figure 18A:
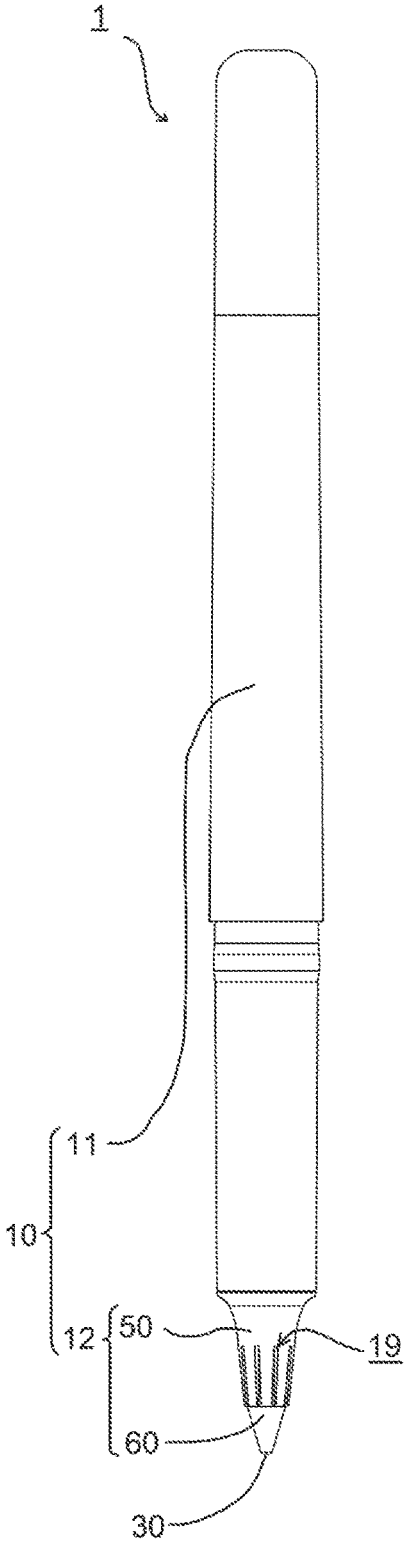
FIG. 18A is a front view of a ballpoint pen of a fifth exemplary embodiment of the present invention.

FIG. 18A illustrates an external appearance of a ballpoint pen 1 according to a fifth exemplary embodiment. In the fifth exemplary embodiment there are slits 19 provided in a joint 50 at a tip shaft 12. The fifth exemplary embodiment differs from the fourth exemplary embodiment in a structure of the tip shaft 12, but is otherwise similar to the fourth exemplary embodiment, and so explanation will only be given to different points.

Figure 19:
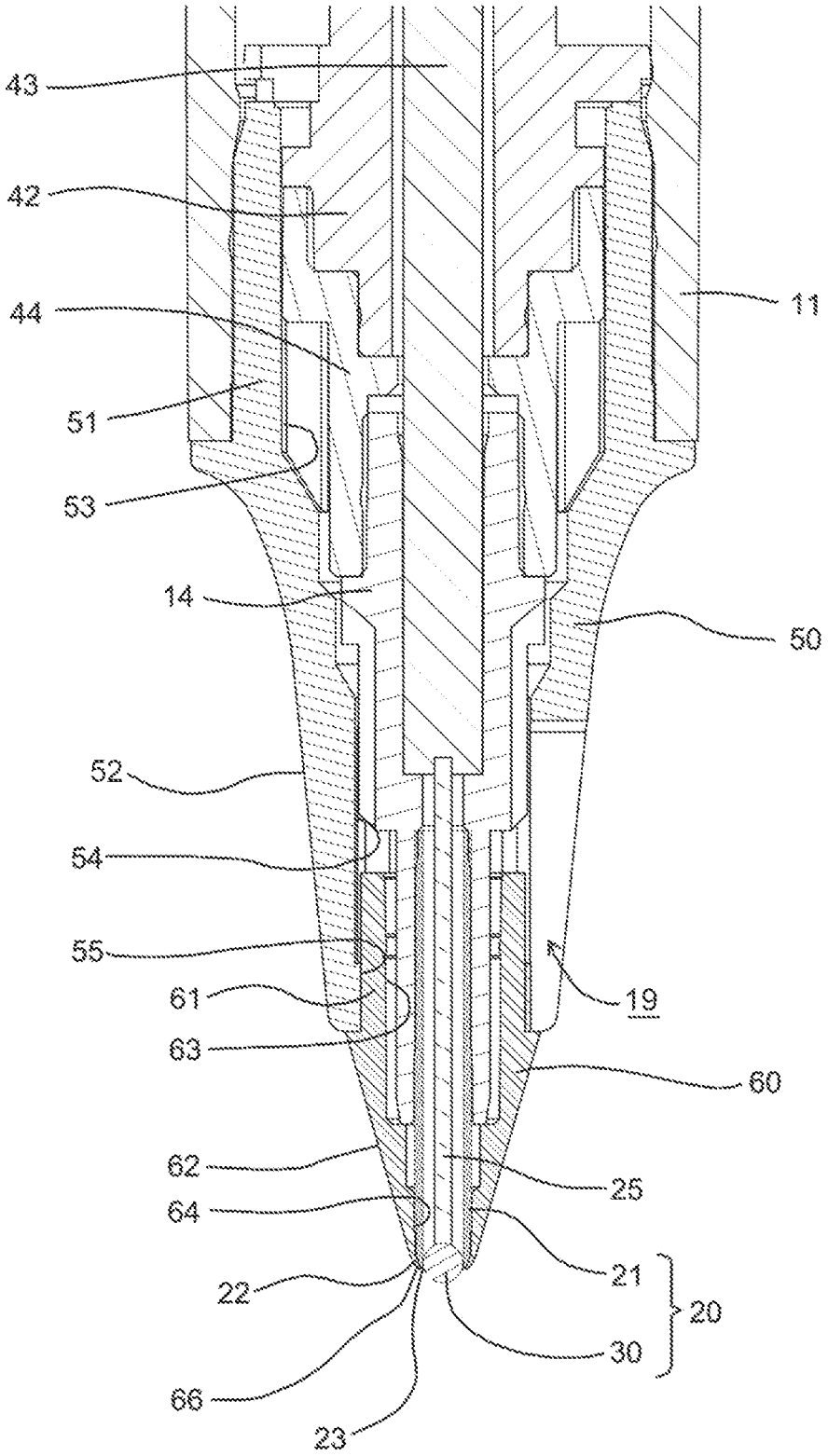
FIG. 19 is a vertical cross-section of a tip portion of a ballpoint pen of the fifth exemplary embodiment.
Figure 20A:
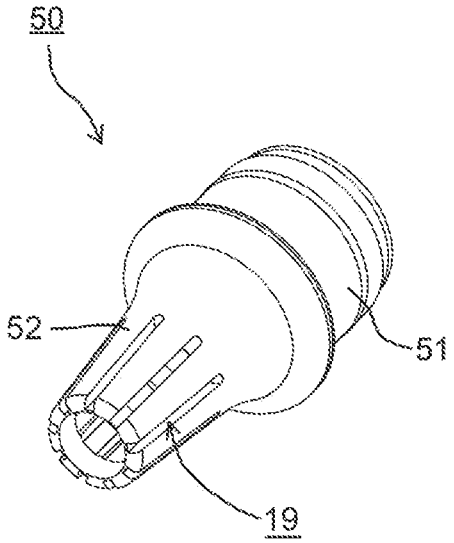
FIG. 20A is a perspective view of a joint employed in a ballpoint pen of the fifth exemplary embodiment.
Figure 20B:
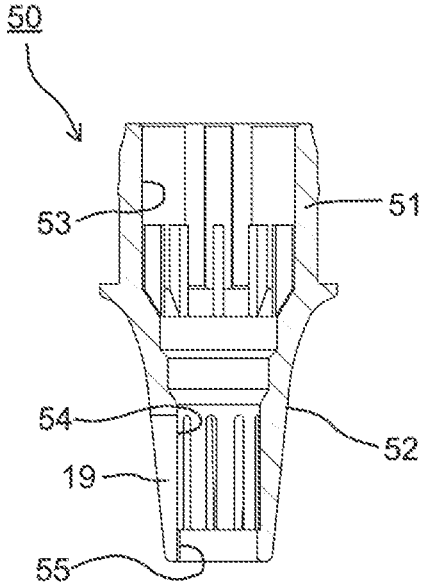
FIG. 20B is a vertical cross-section thereof.
Figure 21:
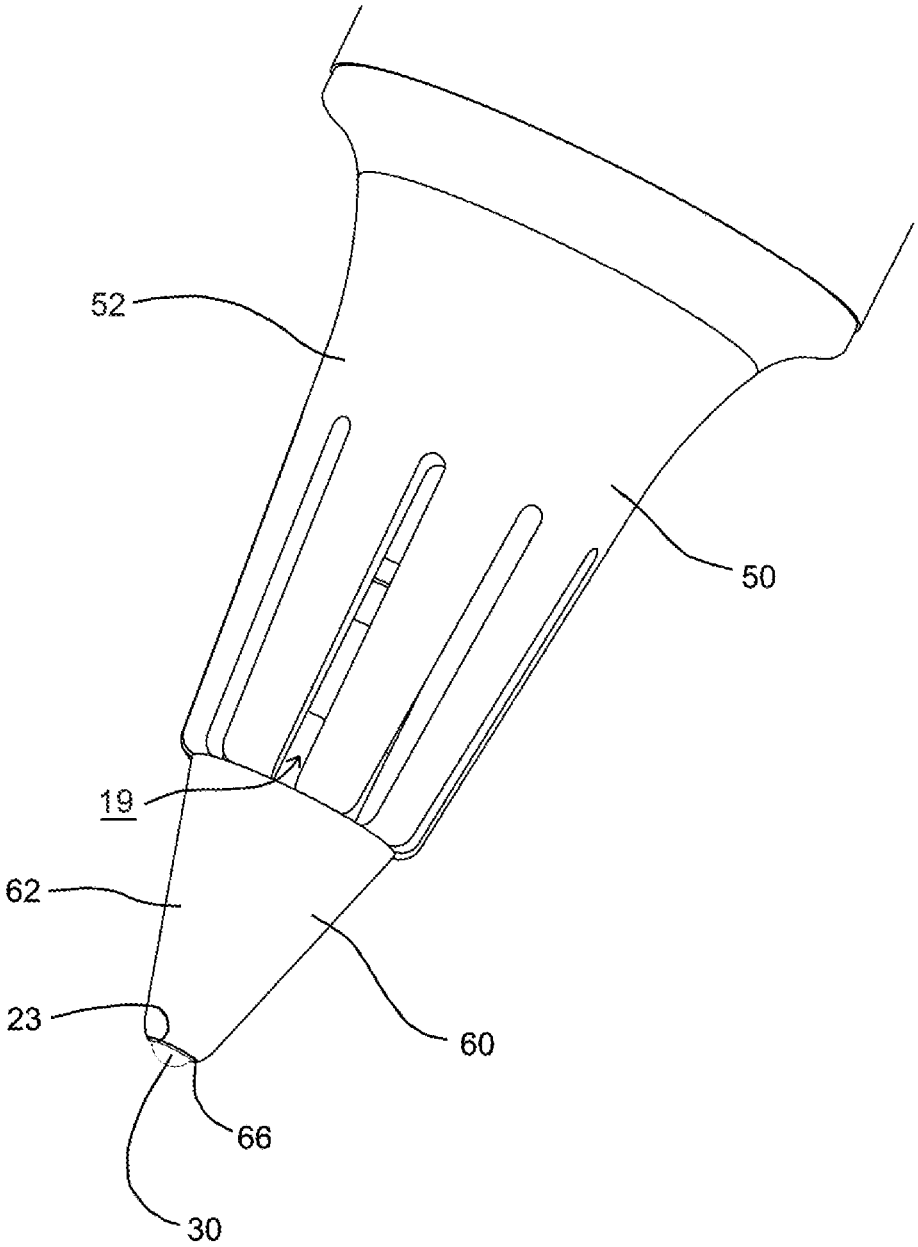
FIG. 21 is a perspective view of a tip shaft of a ballpoint pen of the fifth exemplary embodiment.

As illustrated in FIG. 19, the joint 50 is a component made from a synthetic resin, and is configured with a cylindrical shaped joint fixing portion 51, and a substantially circular conical shaped joint tapered portion 52 continuously provided to the joint fixing portion 51. A hole is formed through from a rear end toward a tip end of the joint 50, with a rear insertion hole 53 provided at an inner face of the joint fixing portion 51, and a central insertion hole 54 with a smaller diameter than that of the rear insertion hole 53 provided at an inner face in the vicinity of a center of the joint tapered portion 52. A front insertion hole 55 with a diameter slightly smaller than that of the central insertion hole 54 is provided at the inner face in the vicinity of a tip end of the joint tapered portion 52. Moreover, as illustrated in FIG. 20A, FIG. 20B, and FIG. 21, nine slits 19 spanning from a tip end of the joint 50 to the vicinity of the center of the joint tapered portion 52 are evenly disposed in a pattern radiating out from a central axis. In the vicinity of the central insertion hole 54, the slits 19 pierce through up to an internal face of the central insertion hole 54.

Figure 18B:
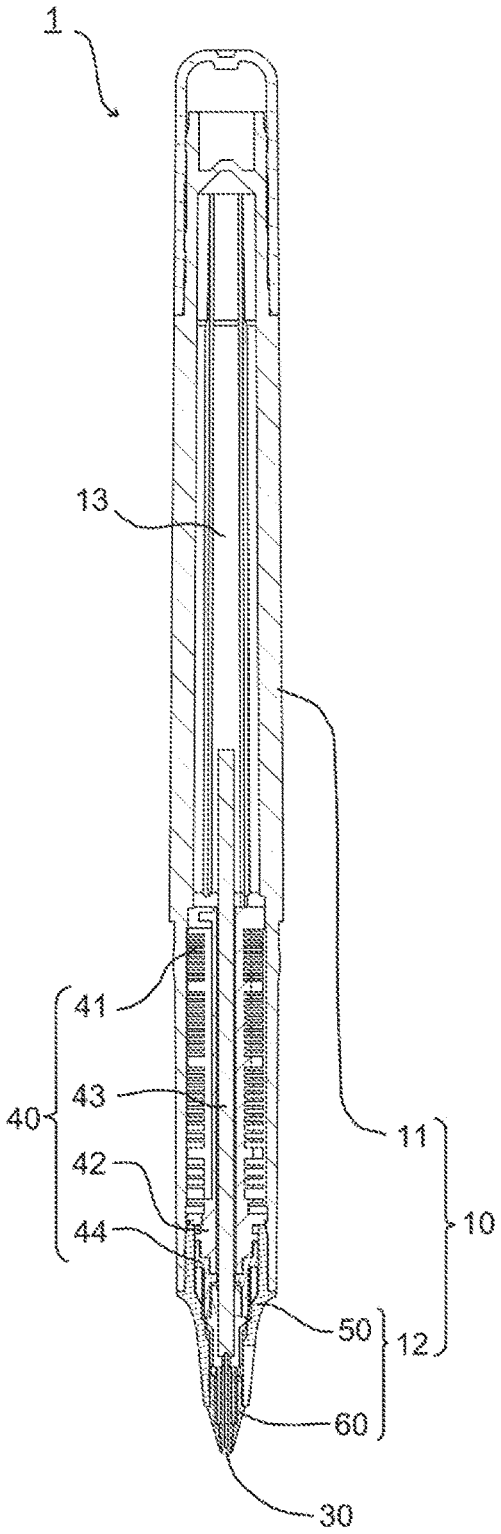
FIG. 18B is a vertical cross-section thereof.

As illustrated in FIG. 18B and FIG. 19, an ink supply section 40 and an internal joint 14 that fits into the ink supply section 40 are inserted into the joint 50 from its rear. Herein, a tip piece 44 fits into the rear insertion hole 53, and the internal joint 14 is inserted into the central insertion hole 54. The joint 50 is fixed to a shaft body 11 by the joint fixing portion 51 fitting into an inner face in the vicinity of a tip end of the shaft body 11.

As illustrated in FIG. 19 and FIG. 21, an outer member 60 is a component made from synthetic resin and configured by a cylindrical shaped outer fixing portion 61 and a substantially circular conical shaped outer tapered portion 62 continuously provided to the outer fixing portion 61. A beveled outer tip portion 66 is provided at a tip end of the outer tapered portion 62. A hole is formed through from a rear end toward a tip end of the outer member 60, with a rear insertion hole 63 provided at an inner face of the outer fixing portion 61, and a front insertion hole 64 of a smaller diameter than the rear insertion hole 63 provided at an inner face in the vicinity of the tip end of the outer tapered portion 62. The outer fixing portion 61 is fixed to the joint 50 by being fitted into the front insertion hole 55 of the joint 50. The outer member 60 covers a ballpoint pen tip 20. Herein, the tip end portion of the internal joint 14 is inserted into the rear insertion hole 63, and the ballpoint pen tip 20 projecting out from the internal joint 14 is fitted into the front insertion hole 64. As illustrated in FIG. 21, only a writing ball 30, a swaged section 23 covering the writing ball 30, and the outer tip portion 66 are exposed in the vicinity of the tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer tip portion 66.

The ballpoint pen 1 has a structure readily flexing in the vicinity of the slits 19. This enables the outer member 60 to be tilted from a central axis of the shaft body 11 according to the force applied during writing. This enables a writing sensation akin to that of a fountain pen to be obtained.

If the writing ball 30 and the outer tip portion 66 contact the writing surface due to the outer member 60 tilting from the central axis of the shaft body 11, ink adhering to a surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing in the vicinity of the slits 19.

Sixth Exemplary Embodiment

Figure 22A:
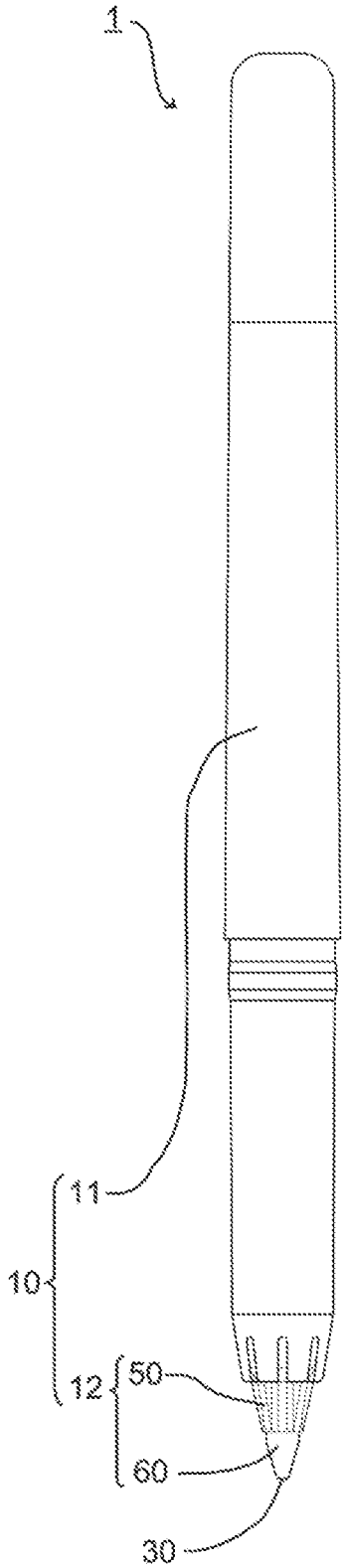
FIG. 22A is a front view of a ballpoint pen of a sixth exemplary embodiment of the present invention.

FIG. 22A illustrates an external appearance of a ballpoint pen 1 according to a sixth exemplary embodiment. In the sixth exemplary embodiment, slits 19 are provided in a tip shaft 12 inside a joint 50. The sixth exemplary embodiment differs from the fourth exemplary embodiment in the structure of the tip shaft 12, but is otherwise similar to the fourth exemplary embodiment, and so explanation will only be given to different points.

Figure 24A:
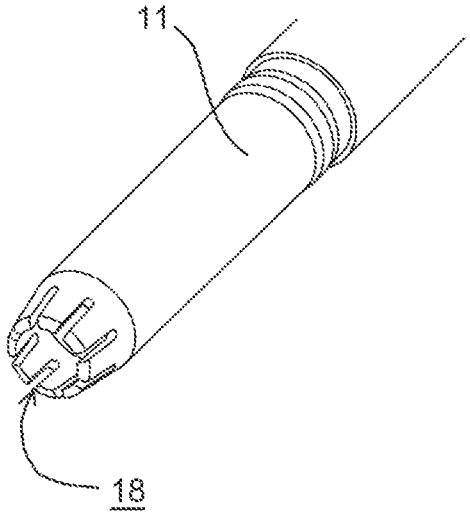
FIG. 24A is a perspective view of the front of a shaft body employed in a ballpoint pen of the sixth exemplary embodiment.
Figure 24B:
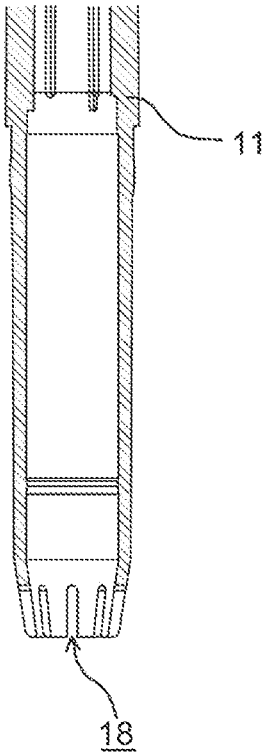
FIG. 24B is a vertical cross-section thereof.

As illustrated in FIG. 22A, FIG. 24A and FIG. 24B, cutouts 18 are formed in a reduced diameter portion at a front of a shaft body 11, from a tip end of the reduced diameter portion to approximately two-thirds of the way along the reduced diameter portion.

Figure 25A:
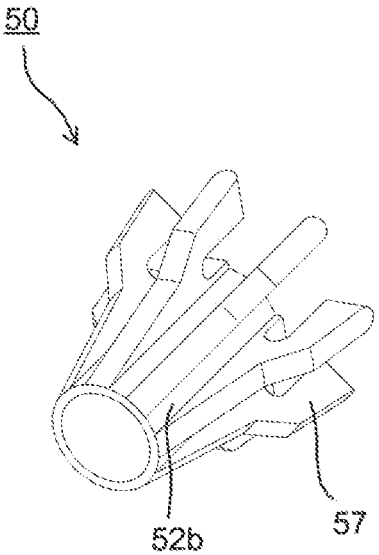
FIG. 25A is a perspective view of a joint employed in a ballpoint pen of the sixth exemplary embodiment.
Figure 25B:
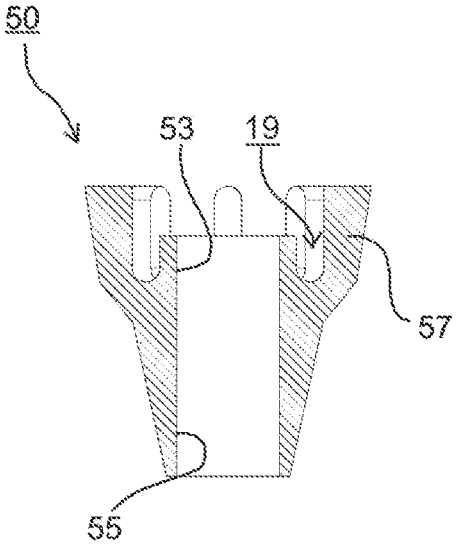
FIG. 25B is a vertical cross-section thereof.

As illustrated in FIG. 25A and FIG. 25B, the joint 50 is a component made from a synthetic resin, and is configured with a cylindrical shaped joint cylinder 52*b*, and substantially triangular shaped projections 57 evenly disposed at eight locations on an outer peripheral face of the joint cylinder 52*b* and formed axially projecting such that a portion of each of the projections 57 projects out to a rear of the joint cylinder 52*b*. Slits 19 are formed from a rear end of the projections 57 to approximately one-third of a rear side of the joint 50 in a pattern radiating out from the central axis, such that gaps arise between the projections 57 and the joint cylinder 52*b*. A hole is formed through from a rear end toward a tip end of the joint 50, with a rear insertion hole 53 provided at an inner face at the rear of the joint cylinder 52*b*, and a front insertion hole 55 of the same diameter as the rear insertion hole 53 provided at the inner face at a front of the joint cylinder 52*b*.

Figure 22B:
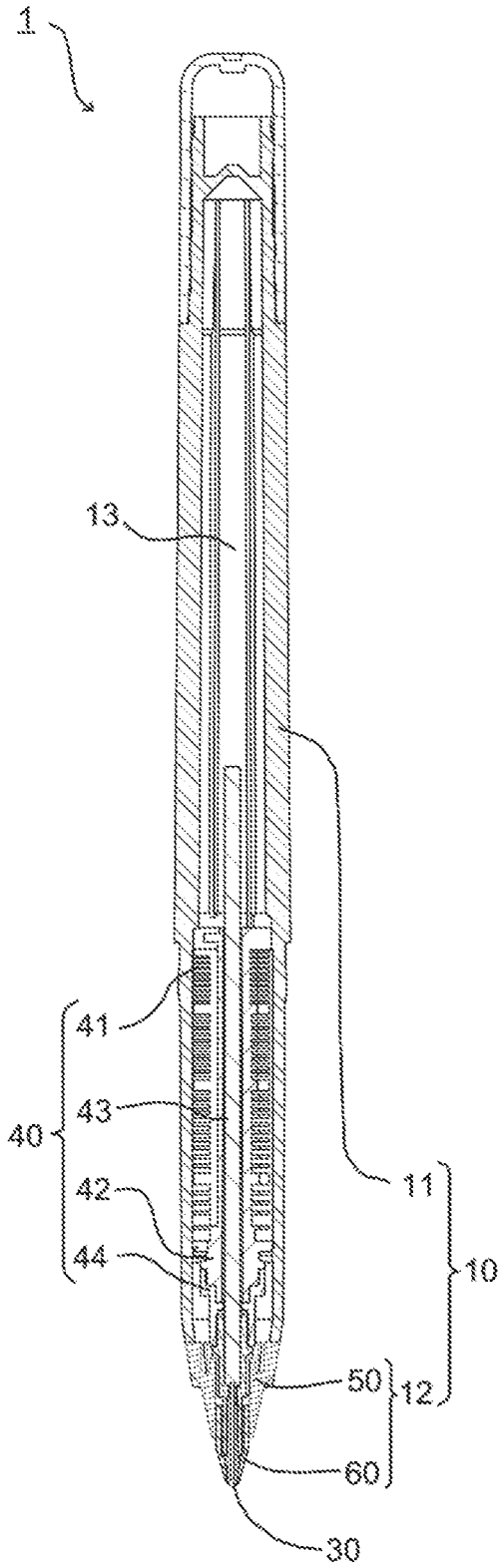
FIG. 22B is a vertical cross-section thereof.
Figure 23:
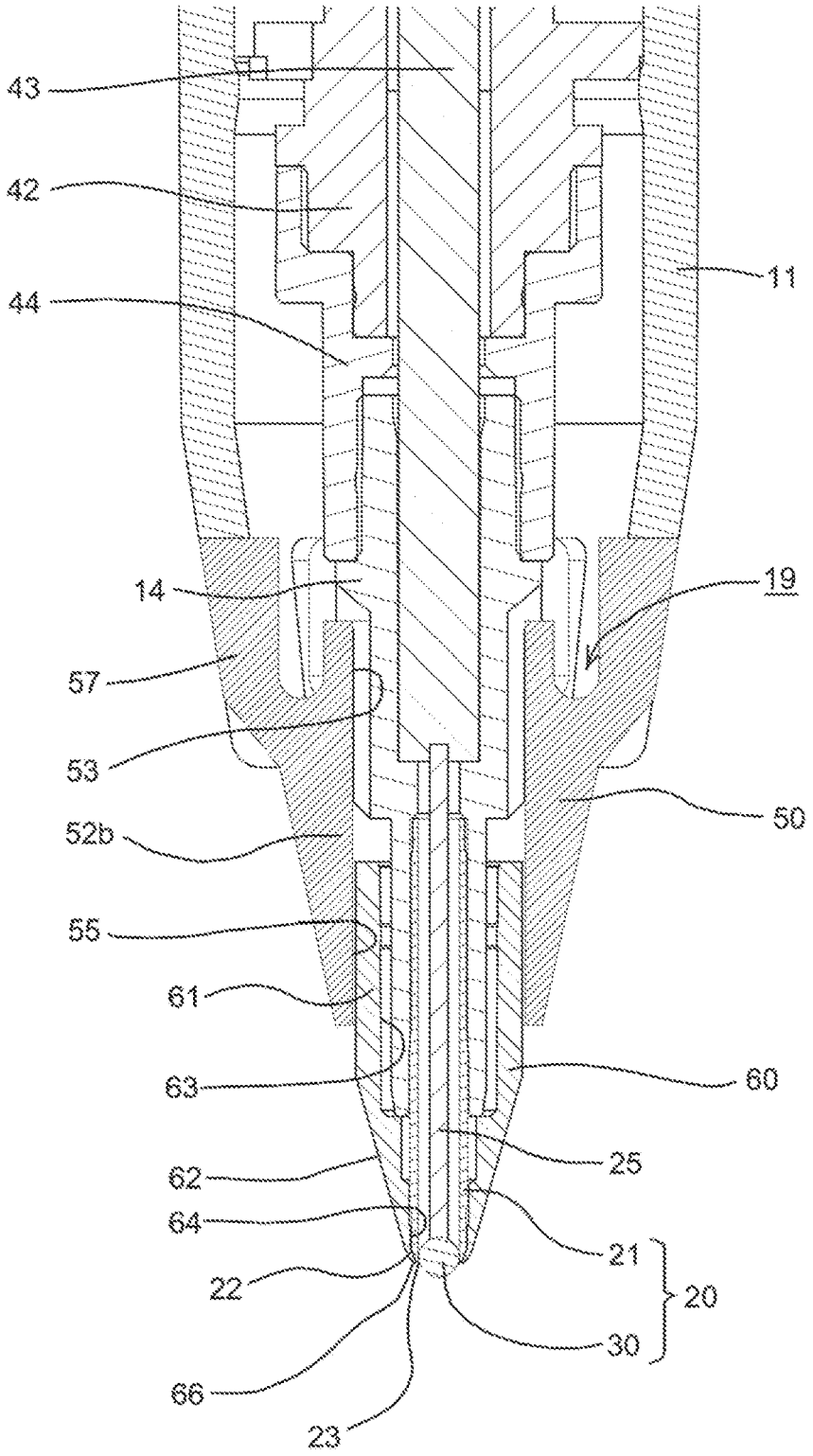
FIG. 23 is a vertical cross-section of a tip portion of a ballpoint pen of the sixth exemplary embodiment.

As illustrated in FIG. 22B and FIG. 23, an internal joint 14 that fits into the ink supply section 40 is inserted into the joint 50 from its rear. The joint 50 is fixed to the shaft body 11 by the projections 57 fitting into the cutouts 18 of the shaft body 11.

Figure 26:
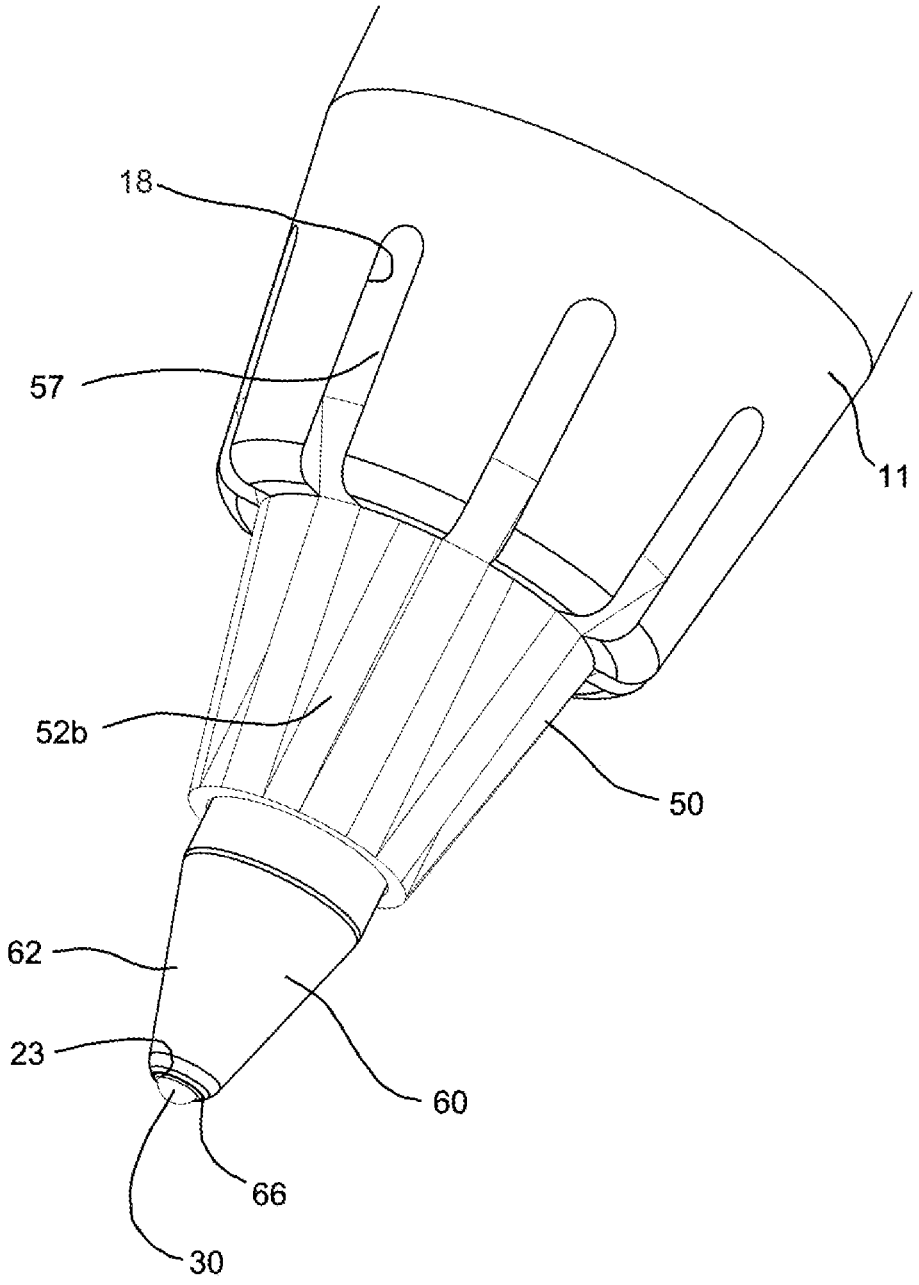
FIG. 26 is a perspective view of a tip shaft of a ballpoint pen of the sixth exemplary embodiment.

As illustrated in FIG. 23 and FIG. 26, an outer member 60 is a component made from synthetic resin and configured by a cylindrical shaped outer fixing portion 61 and a substantially circular conical shaped outer tapered portion 62 continuously provided to the outer fixing portion 61. A beveled outer tip portion 66 is provided at a tip end of the outer tapered portion 62. A hole is formed through from a rear end toward a tip end of the outer member 60, with a rear insertion hole 63 provided at an inner face of the outer fixing portion 61, and a front insertion hole 64 of a smaller diameter than the rear insertion hole 63 provided at an inner face in the vicinity of the tip end of the outer tapered portion 62. The outer fixing portion 61 is fixed at the joint 50 by being inserted into the front insertion hole 55 of the joint 50. The outer member 60 covers a ballpoint pen tip 20. Herein, a tip end portion of the internal joint 14 is inserted into the rear insertion hole 63, and the ballpoint pen tip 20 projecting out from the internal joint 14 is fitted into the front insertion hole 64. As illustrated in FIG. 26, only a writing ball 30, a swaged section 23 covering the writing ball 30, and the outer tip portion 66 are exposed in the vicinity of the tip end of the outer member 60, in a placement such that when the writing ball 30 and the outer tip portion 66 both contact a writing surface at the same time, a space is generated at a portion surrounded by the writing surface, the writing ball 30, the swaged section 23, and the outer tip portion 66

The ballpoint pen 1 is configured with a structure in which, due to the slits 19, the projections 57 readily flex to front and rear, and to the left and right, with respect to the central axis of the shaft body 11. This enables the outer member 60 to be tilted from the central axis of the shaft body 11 according to the force applied during writing. This enables a writing sensation akin to that of a fountain pen to be obtained.

Moreover, if the writing ball 30 and the outer tip portion 66 contact the writing surface due to the outer member 60 tilting from the central axis of the shaft body 11, ink adhering to a surface of the writing ball 30, and ink flowing out from a non-illustrated ball housing accompanying rotation of the writing ball 30, spreads out under capillary action into the space surrounded by the writing surface, the writing ball 30, the swaged section 23, and the outer tip portion 66. This enables a thicker line to be drawn than a line drawn by the writing ball 30. Namely, the thickness of line drawn can be varied because it is possible to finely adjust the angle of the writing tip end with respect to the writing surface by flexing in the vicinity of the slits 19.

Comparative Examples to Other Writing Implements

Figure 27:
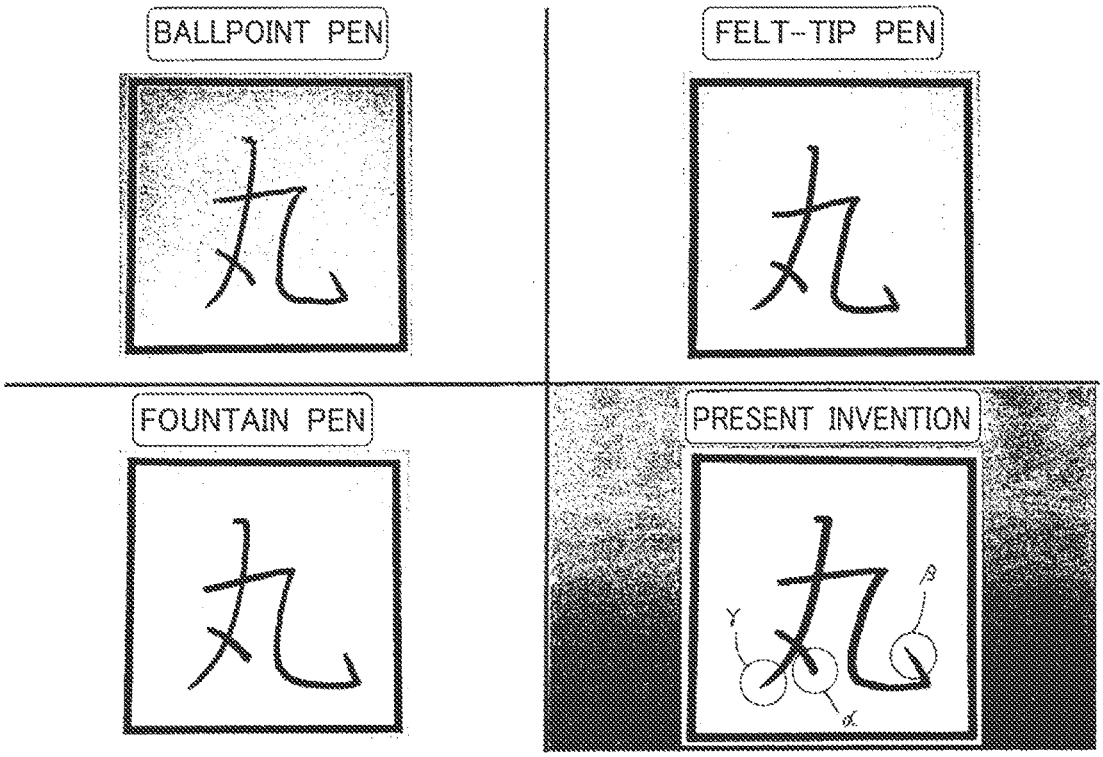
FIG. 27 illustrates a character written with a ballpoint pen according to the present invention, and characters written with conventional writing implements.

FIG. 27 illustrates calligraphy of writing with a ballpoint pen, a felt-tip pen, a fountain pen, and the ballpoint pen 1 according to the present invention. The calligraphy of writing with the ballpoint pen 1 according to the present invention enables easier and higher quality writing of a "stop" α at an end of a stroke, an "upward tick" β, and a "sweeping stroke" γ compared to those with a ballpoint pen, a felt-tip pen, or a fountain pen.

Thus in this manner, in the first, second, and third exemplary embodiments described above, the outer member 60 can be flexed by deformation in the vicinity of the joint between the front half 15 and the rear half 16, and moreover in the fourth, fifth, and sixth exemplary embodiments described above, the outer member 60 can be flexed due to the slits 19, enabling the writing sensation akin to that of a fountain pen to be obtained according to the force applied during writing. The fourth Chinese character in FIG. 27 contains three circles "α," "β" and "γ" to focus on the good results obtained with the claimed invention.

Moreover, the configuration of the ballpoint pen tip 20 and the outer member 60 makes it possible to draw lines of different thicknesses using a single writing tip according to the angle of the ballpoint pen tip. Thus because it is possible to finely adjust the angle of the ballpoint pen tip with respect to the writing surface according to the force applied during writing, the thickness of line drawn is variable markedly, enabling an improvement in the expressiveness of writing to be achieved.

INDUSTRIAL APPLICABILITY

The present invention is applicable to a writing implement such as a ballpoint pen.

The invention claimed is:

1. A ballpoint pen, comprising:

a writing ball;

a holder that retains the writing ball with a swaged section swaged at a tip end of the holder;

an ink supply section that supplies ink into the holder;

a shaft body that internally houses the ink supply section; and a tip shaft that is continuously provided at a tip end of the shaft body, wherein the holder projects out from the tip shaft during writing, and the tip shaft exhibits an elastic action;

wherein the tip shaft is formed by double molding of a front half and a rear half that are interdigitated with each other in a serrated pattern;

wherein the tip shaft comprises a joint fixed to the shaft body, and an outer member that is fixed to the joint and that covers an outer periphery of the holder; and wherein the joint is formed by double molding of a front half and a rear half that are interdigitated with each other in a serrated pattern.

2. The ballpoint pen of claim 1, wherein the joint is integrally formed with the outer member.

3. The ballpoint pen of claim 1, wherein the joint is integrally formed with the shaft body.

4. The ballpoint pen of claim 1, wherein an internal joint is interposed between the ink supply section and the holder.

5. The ballpoint pen of claim 1, wherein an internal joint is interposed between the ink.

6. The ballpoint pen of claim 1, wherein an internal joint is interposed between the ink supply section and the holder.

7. The ballpoint pen of claim 2, wherein an internal joint is interposed between the ink supply section and the holder.

8. The ballpoint pen of claim 3, wherein an internal joint is interposed between the ink supply section and the holder.

* * * * *